US006397800B2

(12) United States Patent
Nohara et al.

(10) Patent No.: US 6,397,800 B2
(45) Date of Patent: Jun. 4, 2002

(54) VALVE CONTROL DEVICE OF INTERNAL COMBUSTION ENGINE

(75) Inventors: Tsuneyasu Nohara; Takanobu Sugiyama, both of Kanagawa; Shinichi Takemura, Yokohama, all of (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/803,141

(22) Filed: Mar. 12, 2001

(30) Foreign Application Priority Data

Mar. 23, 2000 (JP) ..... 2000-081105
Mar. 31, 2000 (JP) ..... 2000-097225

(51) Int. Cl.[7] ..... F01L 1/34
(52) U.S. Cl. ..... 123/90.15; 123/90.17
(58) Field of Search ..... 123/90.15, 90.17

(56) References Cited

U.S. PATENT DOCUMENTS 5,497,737 A * 3/1996 Nakumura ..... 123/90.15
5,531,193 A * 7/1996 Nakamura ..... 123/90.15
5,988,125 A * 11/1999 Hara et al. ..... 123/90.16
6,311,659 B1 * 11/2001 Pierik ..... 123/90.24
6,318,313 B1 * 11/2001 Moriya et al. ..... 123/90.15

FOREIGN PATENT DOCUMENTS

EP 640-749 A1 * 3/1995 ..... 123/90.15
JP 8-177434 7/1996
JP 8-200020 8/1996

OTHER PUBLICATIONS

Lecture Reference #966; Issued from Japanese Automotive Technology Committee; Oct. 1996; p. 2.

* cited by examiner

*Primary Examiner*—Thomas Denion
*Assistant Examiner*—Ching Chang
(74) *Attorney, Agent, or Firm*—Foley & Lardner

(57) ABSTRACT

A first variable valve actuating mechanism varies an operating angular range of an intake valve, a second variable valve actuating mechanism varies a center angle of the operating angular range, and a control unit controls, through the first and second variable valve actuating mechanisms, the operating angular range and the center angle in accordance with an operation condition of the engine. The control unit is configured to carry out, in a low-output operation range of the engine, advancing the center angle with increase of the engine output while making the variation of the center angle larger than that of the operating angular range; and in a middle-output operation range of the engine, increasing the operating angular range with increase of the engine output while making the variation of the operating angular range larger than that of the center angle.

21 Claims, 24 Drawing Sheets

ENGINE SPEED
ENGINE LOAD
OIL TEMP. (COOLING WATER TEMP.)
ELAPSED TIME
C/U

VALVE CONTROL DEVICE OF INTERNAL COMBUSTION ENGINE

BACKGROUND OF INVENTION

1. Field of Invention

The present invention relates in general to control devices for controlling internal combustion engines, and more particularly to the control devices of a type that, for achieving desired operation of the engine, controls the movement of intake and/or exhaust valves in accordance with operation condition of the engine. More specifically, the present invention is concerned with improvement of such control devices, by which the lift characteristics (viz., operating angular range, center angle of the range, etc.,) of intake and/or exhaust valves are controlled in accordance with the engine operation condition.

2. Description of Prior Art

Hitherto, various control devices have been proposed and put into practical use in the field of automotive internal combustion engines. Among them, there is a type that controls an operating angular range of an intake valve and a center angle of the operating angular range in accordance with an engine operation condition for obtaining improved fuel consumption and driveability under a low-speed and low-load operation range, and obtaining sufficient engine output under a high-speed and high-load operation range by practically using the advantage of increased mixture charging effect at the intake stroke.

It is now to be noted that the operating angular range defined in the description corresponds substantially to the open period of the intake valve (or exhaust valve) and is represented by an angular range (°) of the engine crankshaft and the center angle defined in the description corresponds substantially to the center point of the operating angular range or the point assumed when the valve lift shows its maximum degree and is represented by a rotation angle (°) of the engine crankshaft.

SUMMARY OF THE INVENTION

The lecture reference #966 issued from Japanese automotive technology committee in October 1996 shows an engine map (see FIG. 28 of the accompanying drawings) for controlling the operating angular range of the intake valve of a variable valve type internal combustion engine. The engine is equipped with a variable valve mechanism by which the center angle of the operating angular range is continuously changed. In the map, each numeral indicates the crank angle. As is indicated by arrow "A1", under a low-and-medium load operation range, the center angle is advanced with increase of load, while, when the load further increases, the center angle is delayed. While, as is indicated by arrow "B1", under a low-speed operation range, the center angle is advanced with increase of engine speed, while, when the engine speed further increases, the center angle is delayed.

As is understood from the above, under the low-speed and low-and-medium load operation range, the open timing of the intake valve is advanced to increase valve overlapping period thereby to reduce undesired pumping loss. However, during this, the operating angular range is kept unchanged and thus the close timing of the intake valve is inevitably advanced. That is, the close timing of the intake valve is not appropriately controlled. In this case, it is difficult to obtain a desired engine performance, particularly, improved fuel consumption of the engine.

Laid-open Japanese Patent Application 8-177434 shows a valve control device which can vary the valve lift characteristics of the intake and exhaust valves in accordance with engine operation condition. The valve control device disclosed comprises generally a first variable valve actuating mechanism which varies the operating angular range (or valve lift degree) of the intake and exhaust valves in two steps by switching low-speed and high-speed cams and a second variable valve actuating mechanism which varies the center angle of the operating angular range by rotating the cam shaft by a certain degree relative to the crankshaft. In the valve control device of this publication, both the first and second actuating mechanisms are hydraulically actuated by a common oil pump through respective switching valves. Due to usage of the common oil pump, the drive system can be simplified in construction. However, due to inevitability of using such two mechanisms, it is rather difficult to provide precise valve lift characteristics particularly at the time when the control device under the valve switching. Furthermore, due to need of powering the two mechanisms, the oil pump tends to have a larger size.

It is therefore an object of the present invention to provide a valve control device of an internal combustion engine, which is free of the above-mentioned shortcomings.

According to a first aspect of the present invention, there is provided a valve control device of an internal combustion engine having intake and exhaust valves, which comprises a first variable valve actuating mechanism which varies an operating angular range of the intake valve; a second variable valve actuating mechanism which varies a center angle of the operating angular range; and a control unit which controls, through the first and second variable valve actuating mechanisms, the operating angular range and the center angle in accordance with an operation condition of the engine, the control unit being configured to carry out, in a low-output operation range of the engine, advancing the center angle with increase of the engine output while making the variation of the center angle larger than that of the operating angular range; and in a middle-output operation range of the engine, increasing the operating angular range with increase of the engine output while making the variation of the operating angular range larger than that of the center angle.

According to a second aspect of the present invention, there is provided a valve control device of an internal combustion engine having intake and exhaust valves, which comprises first means for varying an operating angular range of the intake valve; second means for varying a center angle of the operating angular range; and control means for controlling, through the first and second means, the operating angular range and the center angle in accordance with an operation condition of the engine, the control means being configured to carry out, in a low-output operation range of the engine, advancing the center angle with increase of the engine output while making the variation of the center angle larger than that of the operating angular range and in a middle-output operation range of the engine, increasing the operating angular range with increase of the engine output while making the variation of the operating angular range larger than that of the center angle.

According to a third aspect of the present invention, there is provided, in a valve control device of an internal combustion engine having intake and exhaust valves, the valve control device including a first variable valve actuating mechanism which varies an operating angular range of the intake valve and a second variable valve actuating mechanism which varies a center angle of the operating angular range, a method for controlling the valve control device in accordance with an operation condition of the engine. The method comprises operating the first and second variable valve actuating mechanisms in such a manner as to, in a low-output operation range of the engine, advance the center angle with increase of the engine output while making the variation of the center angle larger than that of the operating angular range, and operating the first and second variable valve actuating mechanisms in such a manner as to, in a middle-output operation range of the engine, increase the operating angular range with increase of the engine output while making the variation of the operating angular range larger than that of the center angle.

DETAILED DESCRIPTION OF THE EMBODIMENTS

Figure 1:
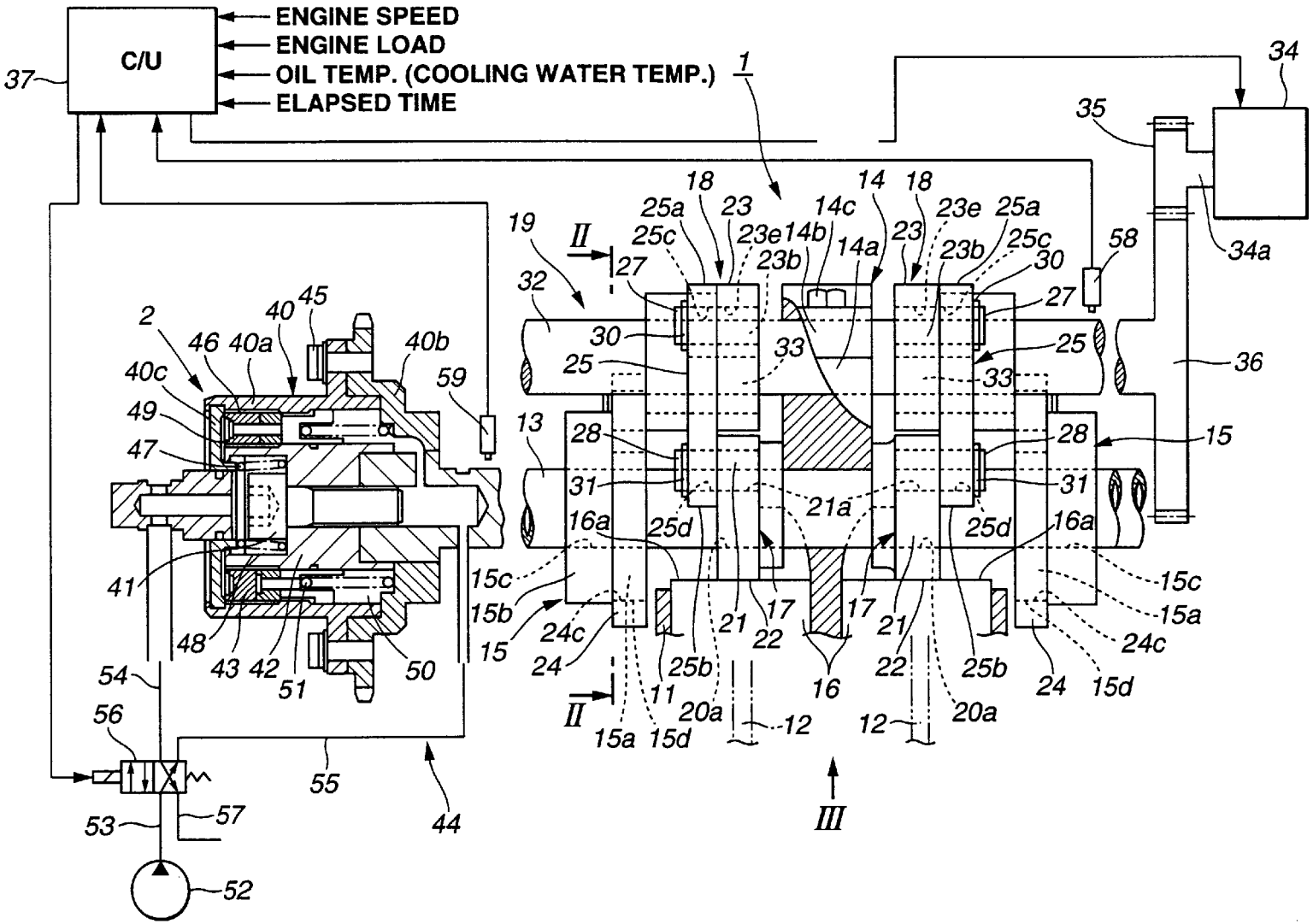
FIG. 1 is a schematic view of a valve control device of an internal combustion engine, which is a first embodiment of the present invention.

In the following, various embodiments of the present invention will be described with reference to the accompanying drawings. For ease of understanding, various directional terms, such as, upper, lower, right, left, upward, downward, et., are used in the description. However, it is to be noted that such directional terms are to be understood with respect to only the drawing or drawings in which the corresponding part is shown.

Figure 2:
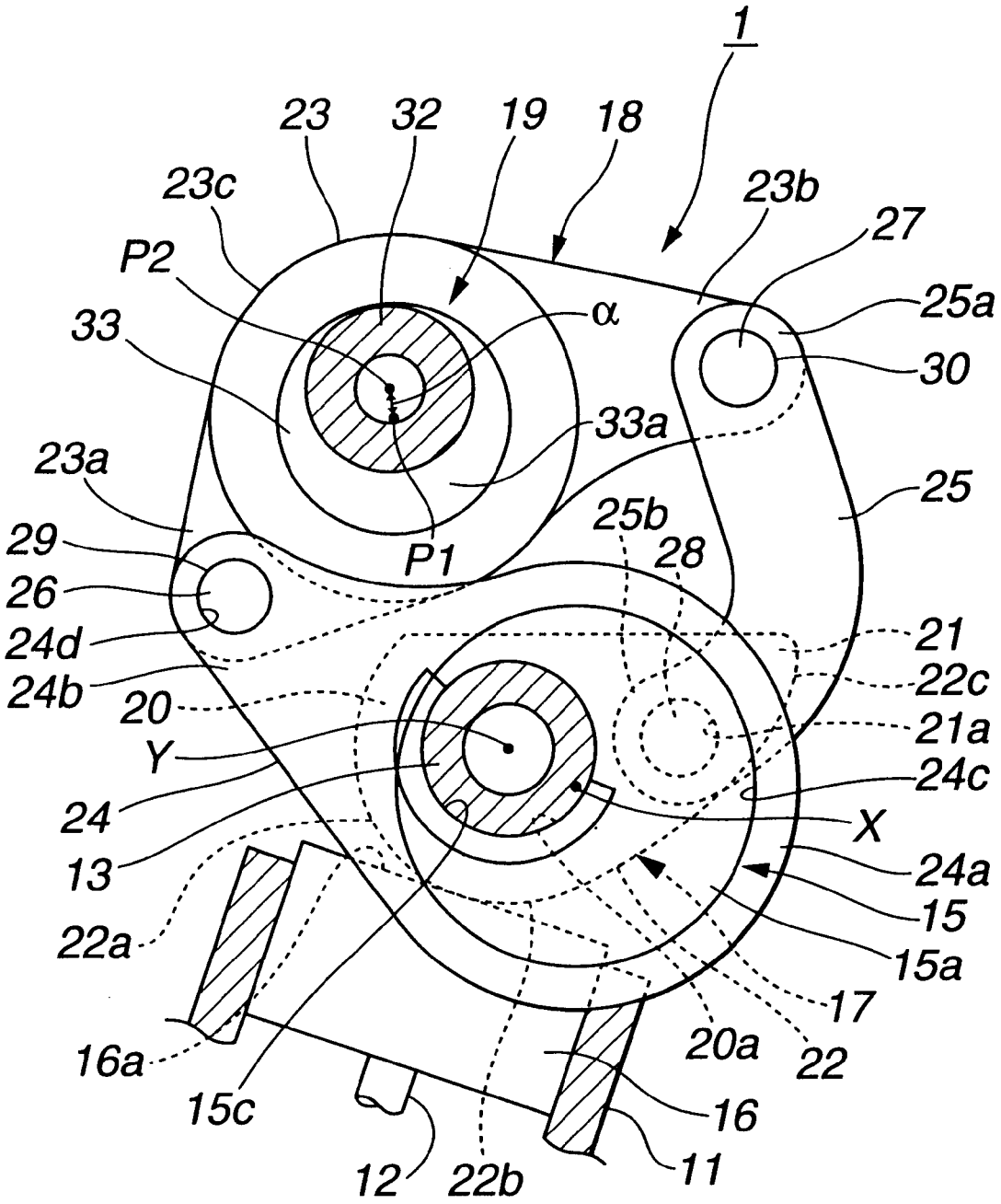
FIG. 2 is an enlarged sectional view taken along the line II—II of FIG. 1, showing a first variable valve actuating mechanism.
Figure 3:
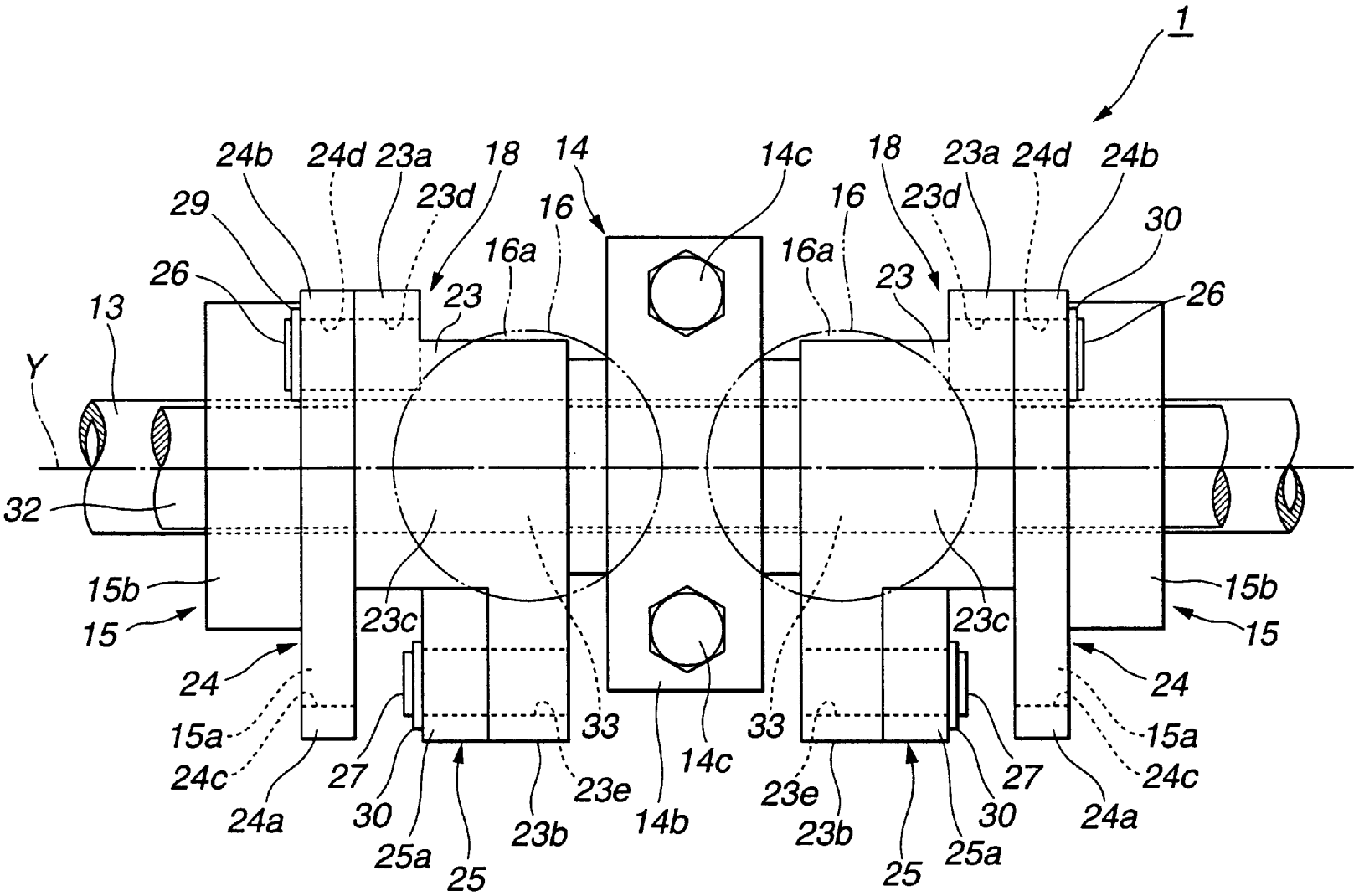
FIG. 3 is an enlarged view taken from the direction of arrow III of FIG. 1, showing parts of the first variable valve actuating mechanism which are located near upper ends of intake valves.

Referring to FIGS. 1 to 3 of the drawings, there is shown a valve control device of an internal combustion engine, which is a first embodiment of the present invention. The valve control device of this first embodiment is constructed to control two intake valves for each cylinder of the engine as will become apparent as the description proceeds.

As is seen from FIG. 1, to a cylinder head 11, there are slidably mounted, through valve guides (not shown), two intake valves 12 and two exhaust valves (not shown) for each cylinder.

The valve control device of the first embodiment comprises generally a first variable valve actuating mechanism 1 that varies or controls the operating angular range of the intake valves 12, a second variable valve actuating mechanism 2 that varies or controls the center angle of the operating angular range of the intake valves 12 and a control unit 37 that controls the first and second variable valve actuating mechanism 1 and 2 in accordance with operation condition of the engine. The control unit 37 comprises a micro-computer including CPU, RAM, ROM and input and output interfaces.

As is seen from FIGS. 1 to 3, the first variable valve actuating mechanism 1 generally comprises a hollow drive shaft 13 that is rotatably held by bearings 14 (only one is shown) mounted on the cylinder head 11, two eccentric drive cams 15 that are tightly disposed on the drive shaft 13, two swing cams 17 that are swingably or rotatably disposed on the drive shaft 13 and slidably contactable with flat upper surfaces 16*a* of two valve lifters 16 arranged on upper ends of the two intake valves 12 to induce open movement of the intake valves 12, two transmission mechanisms 18 that are each interposed between the eccentric drive cam 15 and the corresponding swing cam 17 to transmit rotation of the drive cam 15 to the swing cam 17 and a control mechanism 19 that variably controls the working position of the transmission mechanisms 18.

As is seen from FIG. 1, the drive shaft 13 extends in a direction along which the cylinders are aligned. The drive shaft 13 is driven by a crankshaft of the engine through a timing sprocket 40 of the second variable valve actuating mechanism 2 and a timing chain (not shown) operatively put around the timing sprocket 40 and the drive shaft 13. As shown, the second variable valve actuating mechanism 2 is located at a left end of the drive shaft 13, which will be described in detail hereinafter.

As is seen from FIG. 1, each bearing 14 comprises a main bracket part 14*a* mounted on the cylinder head 11 to support an upper section of the drive shaft 13 and a sub-bracket part 14*b* mounted on an upper end of the main bracket part 14*a* to rotatably support an after-mentioned control shaft 32. The two bracket parts 14*a* and 14*b* are joined together and secured to the cylinder head 11 by means of two bolts 14*c*.

As is seen from FIGS. 2 and 3, each of the eccentric drive cams 15 is generally in the shape of a ring and comprises a cam portion 15*a* and a smaller diameter cylindrical portion 15*b* integrally connected to one side surface of the cam portion 15*a*. The drive cam 15 has an axially extending bore 15*c* into which the drive shaft 13 is press fitted. As is seen from FIG. 2, the shaft center X of the cam portion 15*a* is offset from the shaft center Y of the drive shaft 13 in a radial direction by a given degree. Due to securing between the drive shaft 13 and the drive cams 15, they rotate together like a single unit. As is seen from FIG. 3, the two drive cams 15 are secured to the drive shaft 13 at such positions as not to interfere with the valve lifters 16, and as is seen from FIG. 1, the cam portions 15*a* of the drive scams 15 have on their peripheral surfaces 15*d* identical cam profiles.

As is seen from FIGS. 1 and 2, each of the swing cams 17 comprises an annular base portion 20 that has an opening 20*a* rotatably bearing the drive shaft 13 and a cam nose portion 21 that has a pin hole 21*a*. As is seen from FIG. 2, each swing cam 17 has at its lower periphery a cam surface 22 which comprises a basic semicircular surface 22*a* defined by the annular base portion 20, a swollen surface 22*b* which extends from the basic semicircular surface 22*a* toward the cam nose portion 21 and a lifting surface 22*c* which is located at the leading end of the swollen surface 22*a*. The three surfaces 22*a*, 22*b* and 22*c* of the cam surface 22 are brought into slidably contact with the flat upper surface 16*a* of the corresponding valve lifter 16.

As is seen from FIG. 2, each transmission mechanism 18 comprises a rocker arm 23 that is arranged above the drive shaft 13, a ring-shaped link 24 that pivotally connects one end 23*a* of the rocker arm 23 to the corresponding drive cam 15 and a rod-shaped link 25 that pivotally connects the other end 23*b* of the rocker arm 23 to the corresponding swing cam 17.

As is seen from FIGS. 2 and 3, each rocker arm 23 is shaped like a bell crank, having at a center thereof a tubular base portion 23*c* that is rotatably disposed about an after-mentioned control cam 33. As is seen from FIG. 3, in an end portion 23*a* axially outwardly extending from the tubular base portion 23*c* of each rocker arm 23, there is formed a pin hole 23*d* for putting therein a pin 26 that is pivotally connected to the corresponding ringshaped link 24. While, in the other end portion 23*b* axially inwardly extending from the tubular base portion 23*c* of each rocker arm 23, there is formed another pin hole 23*e* for putting therein another pin 27 that is pivotally connected t one end portion 25*a* of the corresponding rod-shaped link 25.

As is seen from FIG. 2, each of the ring-shaped links 24 comprises a larger annular base portion 24*a* and a projected portion 24*b* projecting radially outward from the base portion 24*a*. In a center part of the base portion 24*a*, there is formed an opening 24*c* that rotatably bears a cylindrical outer surface of the cam portion 15*a* of the corresponding drive cam 15. While, in the projected portion 24*b*, there is formed a pin hole 24*d* for rotatably receiving therein a pin 26.

As is seen from FIGS. 1 and 2, each of the rod-shaped link 25 is shaped like a bell crank, having both ends 25*a* and 25*b*. These ends 25*a* and 25*b* have respective pin holes 25*c* and 25*d* for putting therein respective pins 27 and 28 which are mated with the pin holes 23*e* of the other end 23*b* of the corresponding rocker arm 23 and the pin hole 21*a* of the cam nose portion 21 of the corresponding swing cam 17 respectively.

On one end portion of each pin 26, 27 or 28, there is disposed a snap ring 29, 30 or 31 for restraining an axial movement of the ring-shaped link 24 or the rod-shaped link 25.

As is seen from FIG. 1, the control mechanism 19 comprises the above-mentioned control shaft 32 that extends in parallel with the drive shaft 13, the above-mentioned control cams 33 that are secured to the outer surface of the control shaft 32 to serve as fulcrums for the swinging movement of the rocker arms 23, and an electric motor 34 that controls the rotation angle of the control shaft 32.

As is described hereinabove, the control shaft 32 is rotatably held between a bearing groove formed in the upper end of the main bracket part 14*a* of each bracket 14 and the sub-bracket part 14*b* of the bracket 14. Each of the control cams 33 is cylindrical in shape, and as is seen from FIG. 2, the shaft center P1 of the control cam 33 is offset from the shaft center P2 of the control shaft 32 by a distance "$\alpha$". The control cams 33 and the control shaft 32 rotate together like a single unit.

As is seen from FIG. 1, the electric motor 34 drives or controls the control shaft 32 through first and second spur gears 35 and 36 in accordance with an instruction signal issued from the control unit 37 that detects operation condition of the engine.

As is seen from FIG. 1, the second variable valve actuating mechanism 2 is arranged at a left end of the drive shaft 13 and comprises generally a timing sprocket 40 that is powered by the crank shaft of the engine through a timing chain, a sleeve 42 that is coaxially secured to the leading left end of the drive shaft 13 through bolts 41, a tubular gear 43 that is concentrically displaced between the timing sprocket 40 and the sleeve 42 and a hydraulic circuit 44 that drives the tubular gear 43 forward and backward along the drive shaft 13.

The timing sprocket 40 comprises a tubular main part 40*a* and a sprocket part 40*b* that is coaxially secured the main part 40*a* through bolts 45. Although not shown in the drawing, the timing chain is put around the sprocket part 40*b*. The tubular main part 40*a* has a front open end closed by a front cover 40*c* and has on its inner surface a helical internal gear 46 operatively engaged with the tubular gear 43.

The sleeve 42 is formed with an engaging groove with which the leading left end of the drive shaft 13 is engaged. In a front groove of the sleeve 42, there is installed a coil spring 47 by which the timing sprocket 40 is biased forward, that is, leftward through the front cover 40*c*. The sleeve 42 has on its outer surface a helical external gear 48 operatively engaged with the tubular gear 43.

The tubular gear 43 is of a split member, including front and rear parts which are biased toward each other by means of pins and springs. Cylindrical outer and inner surfaces of the tubular gear 43 are formed with external and internal helical gears which are engaged with the above-mentioned internal and external gears 46 and 48. Before and after the tubular gear 43, there are defined first and second hydraulic chambers 49 and 50. Thus, by applying a hydraulic pressure to these chambers 49 and 50, the tubular gear 43 is forced to move forward or rearward while keeping the meshed engagement with the timing sprocket 40 and the sleeve 42.

It is to be noted that when the tubular gear 43 comes to the frontmost (viz., leftmost) position contacting the front cover 40*c*, each of the intake valves 12 is forced to assume its most delayed position, while, when the tubular gear 43 comes to the rearmost (viz., rightmost) position separating from the front cover 40*c*, each intake valve 12 is forced to assume its most advanced position. Due to the work of a return spring 51 installed in the second hydraulic chamber 50, the tubular gear 43 is forced to assume the frontmost position when no hydraulic pressure is applied to the first hydraulic chamber 49.

The hydraulic circuit 44 comprises an oil pump 52 connected to an oil pan (not shown) of the engine, a main gallery 53 connected to a downstream side of the oil pump 52, first and second hydraulic passages 54 and 55 branched from a downstream end of the main gallery 53 and connected to the first and second hydraulic passages 49 and 50 respectively, a solenoid type switching valve 56 arranged at the branched portion of the main gallery 53 and a drain passage 57 extending from the switching valve 56.

The switching valve 56 is controlled by the control unit 37 upon receiving an instruction signal therefrom.

Into the control unit 37, there are inputted various information signals which are an engine speed signal issued from a crank angle sensor, an intake air amount signal (representing load) from an air flow meter, a water temperature signal from an engine cooling water temperature sensor, an elapsed time signal that represents an elapsed time from engine starting, etc. By processing these signals, the control unit 37 totally judges the operation condition of the engine. In addition to the above-mentioned information signals, information signals from first and second position sensors 58 and 59 are also inputted to the control unit 37. The first position sensor 58 detects an existing angular position of the control shaft 32 and the second position sensor 59 detects a relative rotation position between the drive shaft 13 and the timing sprocket 40. By processing these information signals, the control unit 37 issues instruction signals to the electric motor 34 and the switching valve 56.

When, with the above-described construction, the drive shaft 13 is rotated in response to the crankshaft of the engine, the ring-shaped links 24 are moved in parallel by the drive cams 15, and at the same time, the swing cams 17 are swung through the rocker arms 23 and the rod-shaped links 25 thereby to open and close the intake valves 12.

By controlling the drive shaft 32 of the first variable valve actuating mechanism 1, the shaft center P2 of the control cams 33 about which the rocker arms 23 swing is displaced, so that the posture of the various links changes inducing a continuous change of the operating angular range of the intake valves 12.

Figure 4A:
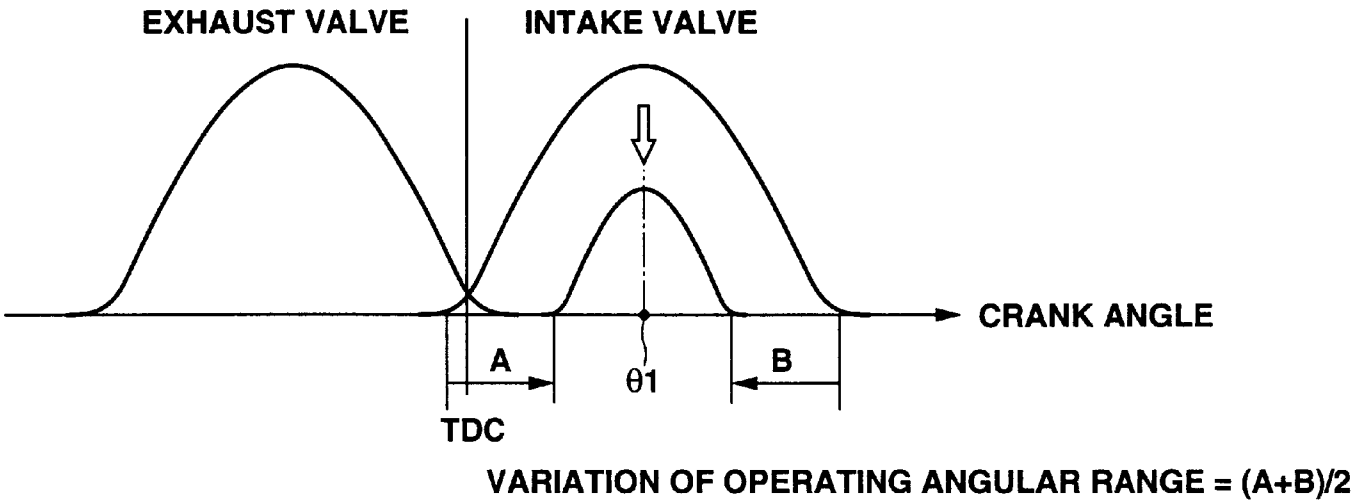
FIGS. 4A and 4B are graphs respectively showing variation of the operating angular range of an intake valve and variation of the center angle of the operating angular range with respect to a rotation angle of a crankshaft.
Figure 4B:
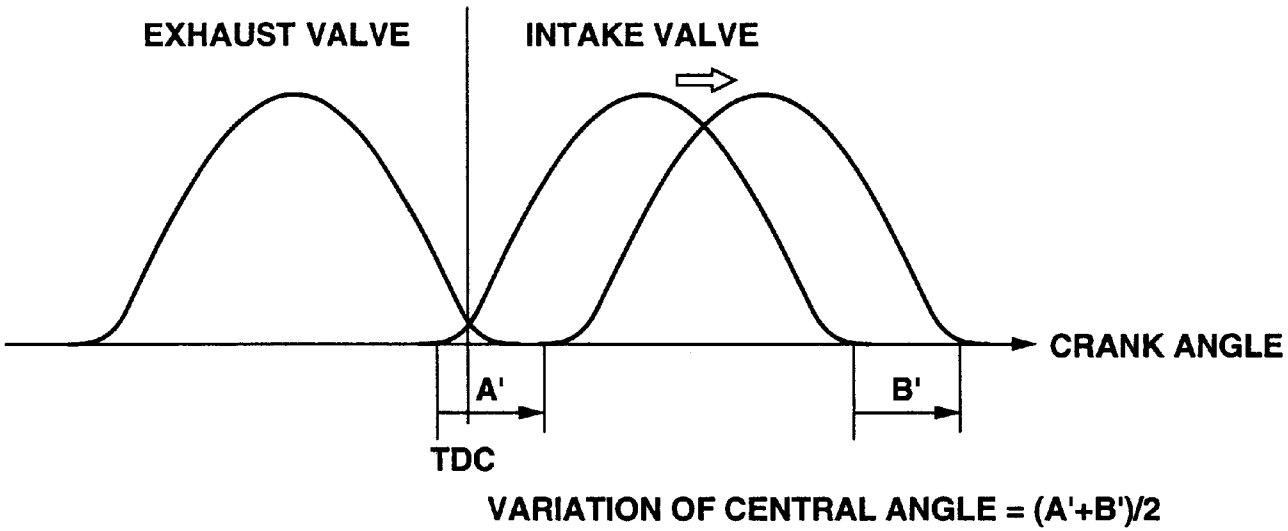
Figure 5:
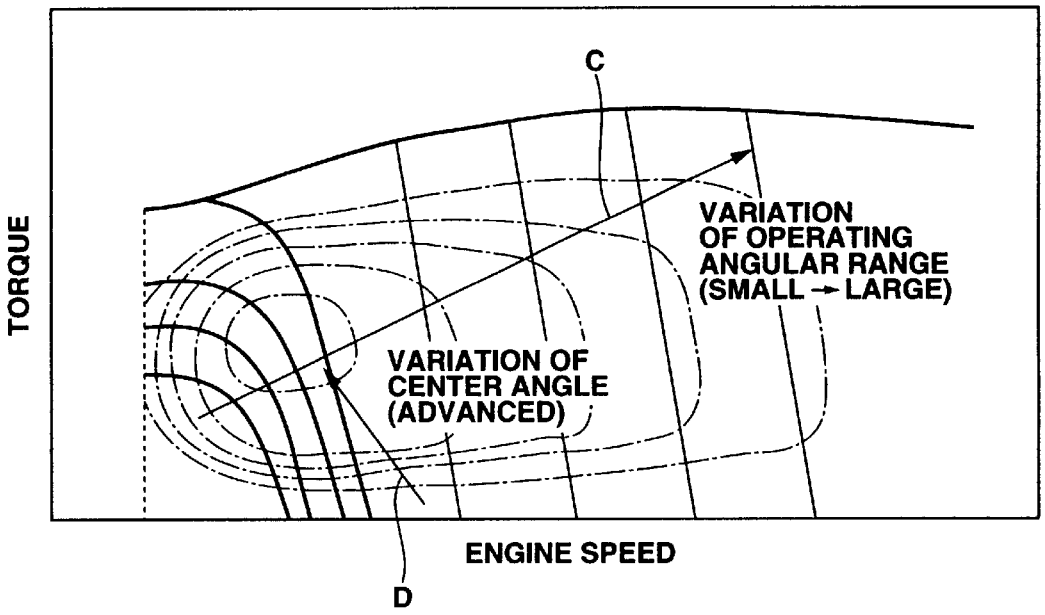
FIG. 5 is an illustration of an engine map used in the first embodiment, which shows variation of the operating angular range of the intake valve and variation of the central of the operating angular range with respect to engine speed and torque.
Figure 6:
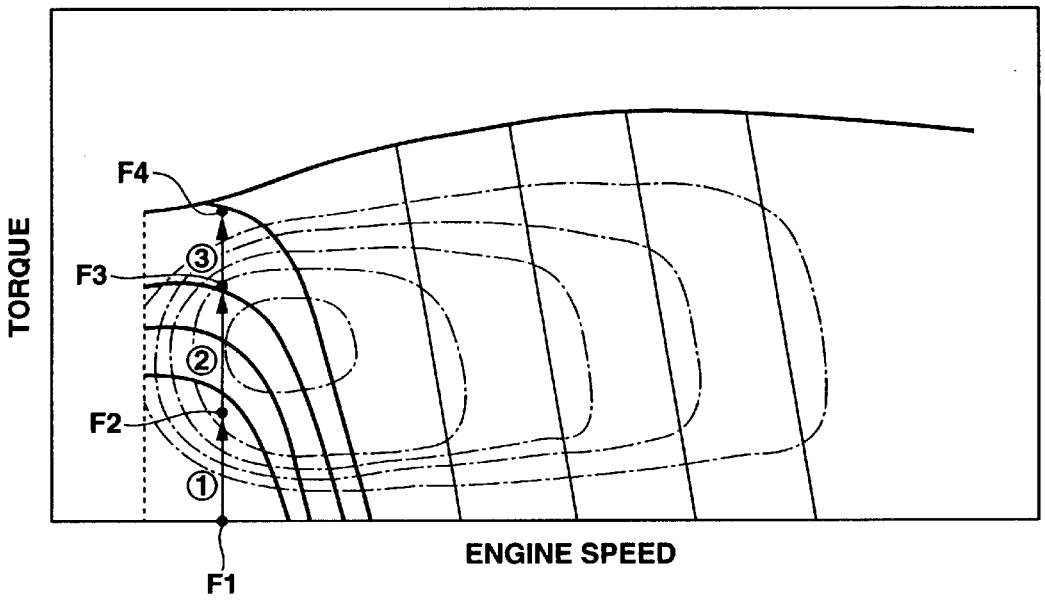
FIG. 6 is an illustration of the engine map, carrying four operation conditions F1 to F4 taken by the engine.
Figure 7A:
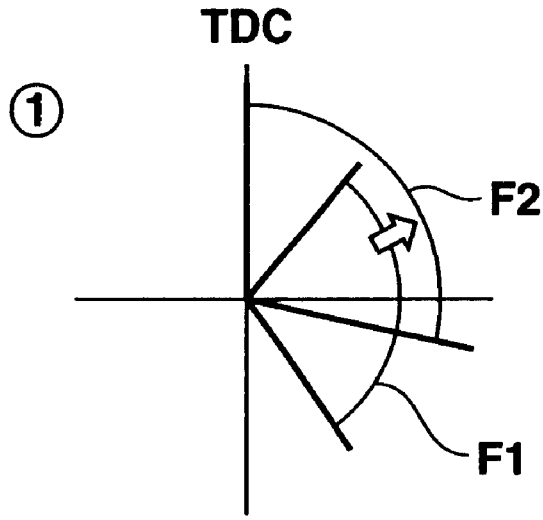
FIGS. 7A, 7B and 7C are circle graphs respectively showing the operating angular range of the intake valve when the engine operation condition changes from the condition of F1 to the condition of F4 of the engine map of FIG. 6.
Figure 7B:
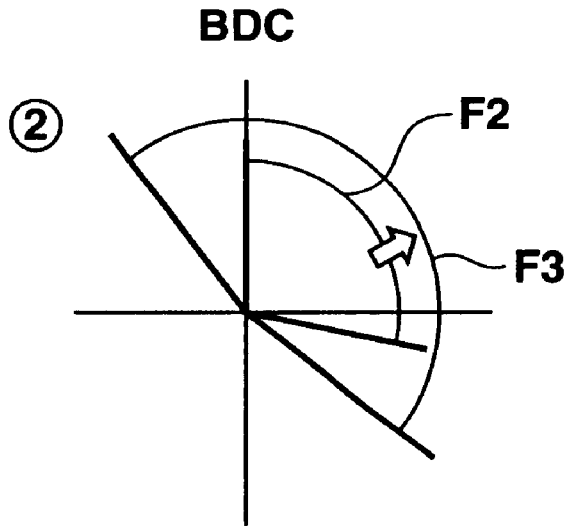
Figure 7C:
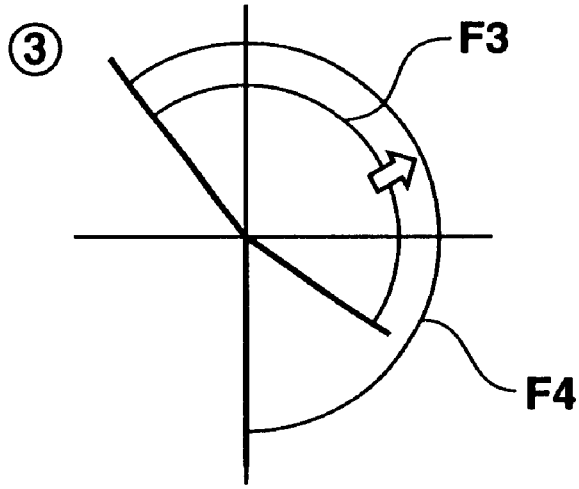

Referring to FIGS. 4A and 4B, there are shown graphs which show the valve lift characteristics of the intake valve 12 and the exhaust valve with respect to the rotation angle of the crankshaft of the engine.

As is seen from FIG. 4A, due to the above-mentioned unique structure of the first variable valve actuating mechanism 1, under operation of the engine, the variation of the center angle of the operating angular range of each intake valve 12 is very small as compared with the variation of the operating angular range, and thus substantially the center angle shows a constant value "θ1".

The variation of the operating angular range is represented by a mean, viz., (A+B)/2, of a delayed degree (or advanced degree) "A" of the open timing "IVO" of the intake valve 12 and an advanced degree (or delayed degree) "B" of the close timing "IVC" of the intake valve 12. While, as is seen from FIG. 4B, the variation of the center angle is represented by a mean, viz., (A'+B')/2, of an advanced degree (or delayed degree) "A'" of the open timing "IVO" of the intake valve 12 and an advanced degree (or delayed degree) "B'" of the close timing "IVC" of the intake valve 12.

In the above-mentioned first variable valve actuating mechanism 1, the contacting between each drive cam 15 and the corresponding ring-shaped link 24 and that between each control cam 33 and the corresponding rocker arm 23 are of a so-called surface contact, and thus the lubrication of such contacting portions is facilitated. Furthermore, since the drive cams 15 and the swing cams 17 are mounted on the drive shaft 13, the mechanism 1 can be assembled compact in size.

By controlling the switching valve 56 of the second variable valve actuating mechanism 2, the rotation angle of the drive shaft 13 relative to the rotation angle of the crankshaft is continuously varied. Thus, as is seen from FIG. 4B, the center angle of the operating angular range of the intake valve 12 is continuously changed keeping the operating angular range generally constant. More specifically, when the switching valve 56 (see FIG. 1) is shifted from the illustrated position to a right position, the first hydraulic passage 54 becomes connected with the main gallery 53 and at the same time, the second hydraulic passage 55 becomes connected with the drain passage 57. With this movement, the tubular gear 43 is shifted from the frontmost position to the rearmost position, and thus, the center angle of the operating angular range of each intake valve 12 is continuously varied from a value corresponding to the most delayed condition to a value corresponding to the most advanced condition.

FIGS. 5 to 9 are illustrations of an engine map used in the first embodiment of the present invention, which shows in a three-dimensional fashion the variation of the operating angular range of the intake valve 12 and the variation of the center angle of the operating angular range with respect to the engine speed and engine torque. In these maps, the operating angular range is indicated by a thicker solid line, while the center angle is indicated by a phantom line. With reference to this engine map, the first and second variable valve mechanisms 1 and 2 are driven for controlling the existing operating angular range and the existing center angle. The arrow-headed line "C" indicates the direction in which the operating angular range is increased, while, the arrow-headed line "D" indicates the direction in which the center angle is advanced.

FIGS. 7A, 7B, 7C, 9A, 9B and 9C are circle graphs respectively showing the operating angular range of the intake valve 12 when the engine takes operation conditions F1 to F8.

In the following, the variation of the operating angular range and that of the center angle, which are induced by increase of engine load under a low-and-middle speed operation range of the engine, will be described with reference to FIGS. 6 and 7A to 7C.

(1) In a low-load operation range (viz., extremely low load condition F1 to low-and-middle load condition F2), the intake air amount needed is relatively small and thus basically the open timing "IVO" of the intake valve is set at a point after (viz., delayed) the top dead center (TDC) and the close timing "IVC" of the valve 12 is set at a point before (viz., advanced) the bottom dead center (BDC).

In such low-load operation range, for reducing pumping loss, that is, for improving fuel consumption of the engine, the IVC is advanced to reduce the intake air amount thereby inducing a relative increase of a throttle valve open degree. However, if, in the extremely low load condition F1, the IVC is much advanced, the effective compression ratio becomes very small. In this case, satisfied mixture combustion is not expected. Thus, in the present invention, the advance of the IVC is carried out in accordance with increase of load. Thus, in the invention, even under such condition F1, stable combustion is obtained and pumping loss is reduced improving fuel consumption.

Furthermore, in the extremely low load condition F1, the IVO is set after (viz., delayed) the top dead center (TDC). With this, the differential pressure at the time of opening the intake valve 12 is increased and thus the mixture flow is increased thereby inducing a stable combustion of the mixture. Furthermore, because of restraint of the operating angular range, the friction of the intake valve 12 is reduced. Since, in the condition F1, the needed intake air amount increases with increase of engine load, the open timing "IVO" of the intake valve is advanced toward the top dead center (TDC) in accordance with the load.

That is, in the low-load range, for advancing the IVO and delaying the IVC with increase of the engine load, the operating angular range is kept at a constant level and the center angle is advanced. In other words, the variation of the center angle is controlled larger than that of the operating angular range.

(2) In a middle load operation range (viz., middle load condition F2 to middle-high load condition F3), the needed intake air amount increases with increase of the engine load. Thus, for advancing the IVO before the top dead center (TDC) and delaying the IVC toward the bottom dead center (BDC), the center angle is kept at a constant level and the operating angular range is increased. That is, the variation of the operating angular range is controlled sufficiently larger than that of the center angle.

Thus, in the middle load range, the IVO is advanced with respect to the close timing of the exhaust valve (viz., valve overlapping) with increase of the load, so that the residual gas is caught by newly led intake air thereby reducing the pumping loss and thus improving the fuel consumption. By delaying the IVC, the amount of the newly led intake air, which would be reduced with increase of the valve overlapping, can be compensated.

(3) In a high load operation range (middle-high load condition F3 to maximum load condition F4), the IVO is delayed with increase of engine load in a manner to shift back the IVO to a point near the top dead center (TDC) in the maximum load condition F4. With this, the rate of the residual gas caused by the valve overlapping can be reduced. In addition, to increase the engine torque by increasing the charging efficiency, the IVC is delayed. Accordingly, in the high load range, both the IVO and IVC are delayed with increase of the engine torque to effectively produce the torque. For this, the center angle is delayed keeping the operating angular range of the intake valve 12 at a constant level. In other words, the variation of the center angle is controlled sufficiently larger than that of the operating angular range.

Figure 8:
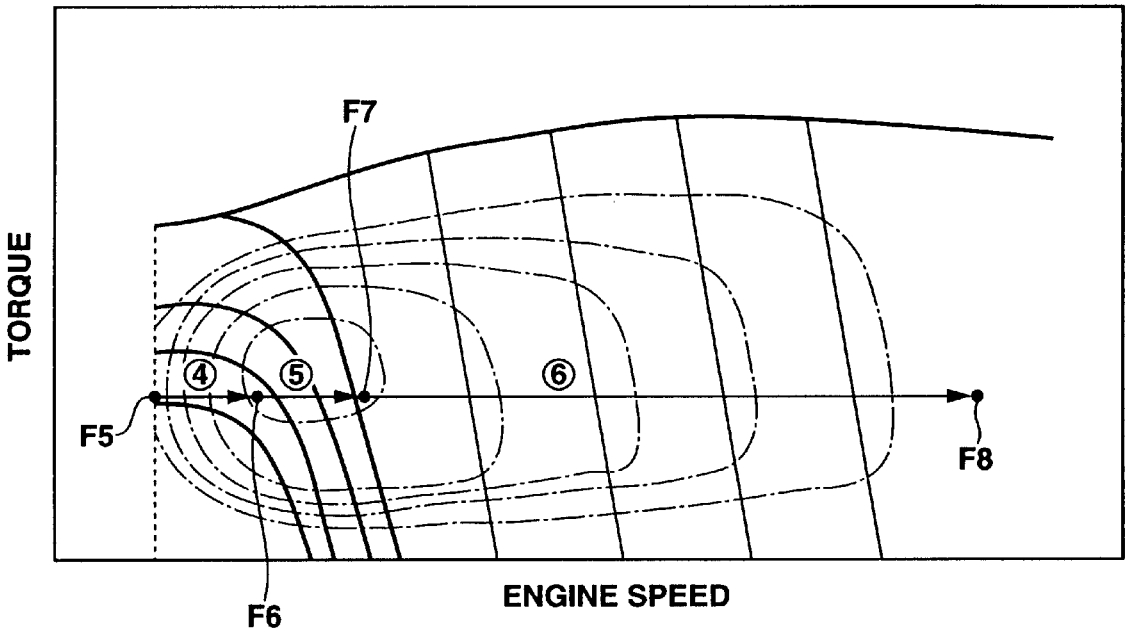
FIG. 8 is an illustration of the engine map, carrying other operation conditions F5 to F8 taken by the engine.
Figure 9A:
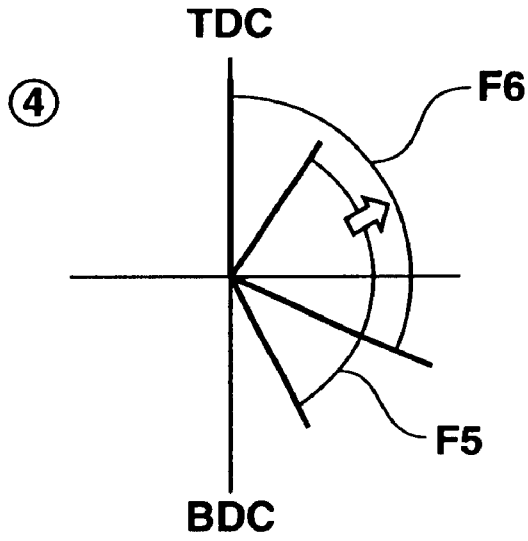
FIGS. 9A, 9B and 9C are circle graphs respectively showing the operating angular range of the intake valve when the engine operation condition changes from the condition of F5 to the condition of F8 of the engine map of FIG. 8.
Figure 9B:
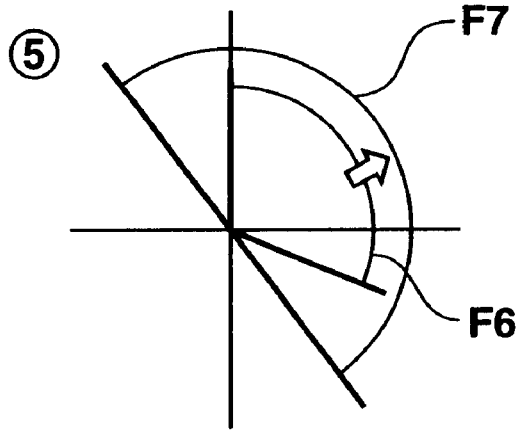
Figure 9C:
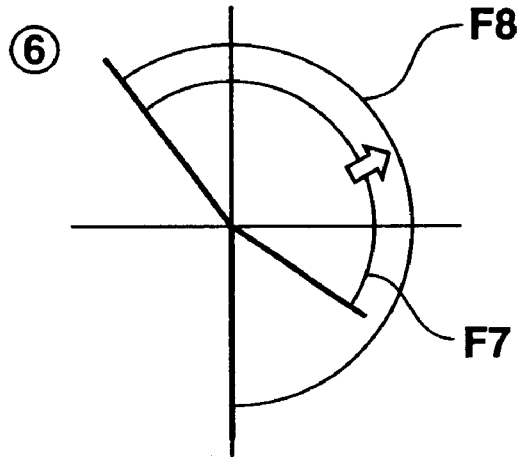

In the following, the variation of the operating angular range and that of the center angle, which are induced by increase of the engine speed under a low-and-middle load operation range, will be described with reference to FIGS. 8 and 9.

(4) In a low-speed operation range (viz., extremely low speed condition F5 to low-and-middle speed condition F6), the needed intake air amount is relatively small. Thus, in this operation range, the IVO is set at a point after (viz., delayed) the top dead center (TDC) and the IVC is set at a point before (viz., advanced) the bottom dead center (BDC).

In such low-speed operation range, for reducing pumping loss, that is, for improving fuel consumption of the engine, it may be preferable to advance the IVC to reduce the intake air amount causing a relative increase of a throttle valve open degree. However, if, in the extremely low speed condition F5, the IVC is much advanced, the effective compression ratio becomes very small inducing a possibility of an unstable combustion because in the condition F5, the velocity of the intake air is small and the gas flow is poor. According to the present invention, the IVC is advanced in accordance with increase of the engine speed. Thus, in the invention, even under such condition F5, stable combustion is obtained and pumping loss is reduced improving fuel consumption.

Furthermore, in the extremely low speed condition F5, the IVO is set after (viz., delayed) the top dead center (TDC). With this, the differential pressure at the time of opening the intake valve 12 is increased and thus the mixture flow is increased thereby inducing a stable combustion of the mixture. Furthermore, because of restraint of the operating angular range, the friction of the intake valve 12 is reduced. Since in the condition F5, the needed intake air amount increases with increase of engine speed, the IVO is advanced toward the top dead center (TDC).

That is, in the low-speed range, for advancing the IVO and delaying the IVC with increase of the engine speed, the operating angular range is kept at a constant level and the center angle is advanced. In other words, the variation of the center angle is controlled larger than that of the operating angular range.

(5) In a middle speed operation range (viz., low-and-middle speed condition F6 to middle-and-high speed condition F7), the needed intake air amount increases with increase of the engine speed. Thus, for advancing the IVO before the top dead center (TDC) and delaying the IVC toward the bottom dead center (BDC), the center angle is kept at a constant level and the operating angular range is increased. That is, the variation of the operating angular range is controlled larger than that of the center angle.

Thus, in the middle speed range, the IVO is advanced with respect to the close timing of the exhaust valve (viz., valve overlapping) with increase of the engine speed, so that the residual gas is caught by the newly led intake air thereby reducing the pumping loss and thus improving the fuel consumption. By delaying the IVC, the amount of the newly led intake air, which would be reduced with increase of the valve overlapping, can be compensated.

(6) In a high speed operation range (middle-high speed condition F7 to maximum speed condition F8), the friction of the engine increases with increase of the engine speed and thus the needed intake air amount increases. Thus, the operating angular range of the intake valve is increased. Furthermore, in such range, the intake air inlet speed increases with increase of the engine speed, and thus, the IVC for the maximum charging efficiency is delayed. Accordingly, in such high speed operation range, the operating angular range is increased and the center angle is delayed in order that the IVO is kept at a constant level and the IVC is delayed with increase of the engine speed. That is, by making the extension degree of the operating angular range equal to the delayed degree of the center angle, improvement in fuel consumption is achieved.

Figure 10:
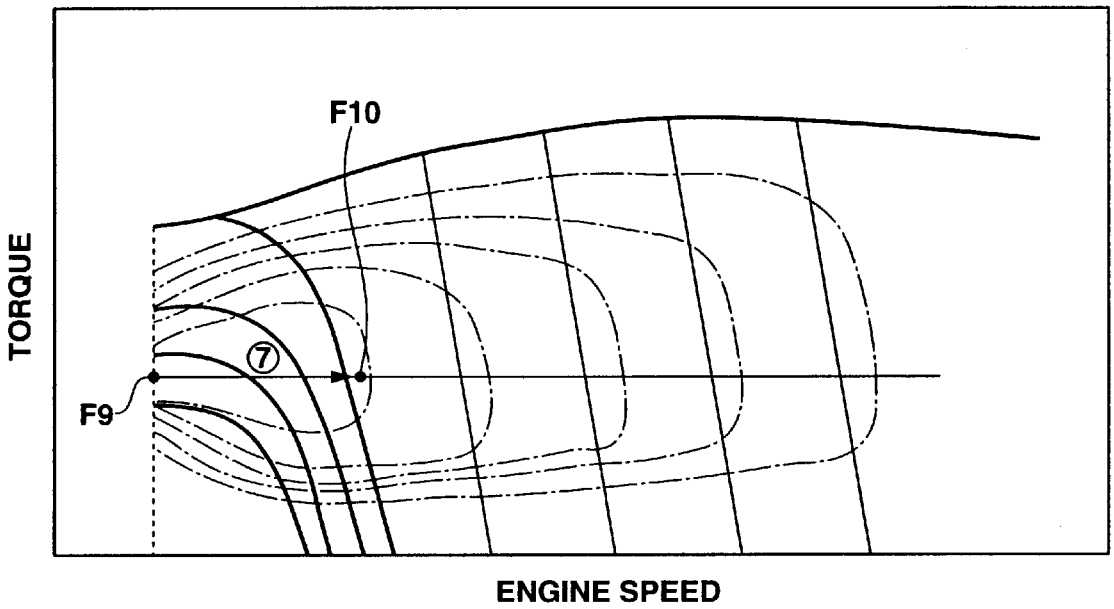
FIG. 10 is an illustration of an engine map used in a second embodiment of the invention, which shows variation of the operating angular range of the intake valve and variation of the center angle of the operating angular range with respect to engine speed and torque.
Figure 11:
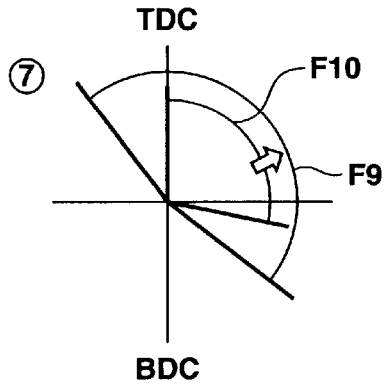
FIG. 11 is a circle graph showing the operating angular range of the intake valve when the engine operation condition changes from the condition of F9 to the condition of F10 of the engine map of FIG. 10.

Referring to FIGS. 10 to 14, there is a second embodiment of the present invention. An engine map used for the second embodiment is shown in FIG. 10, and a circle graph showing the operating angular range of the intake valve in case of the second embodiment is shown in FIG. 11.

Figure 12:
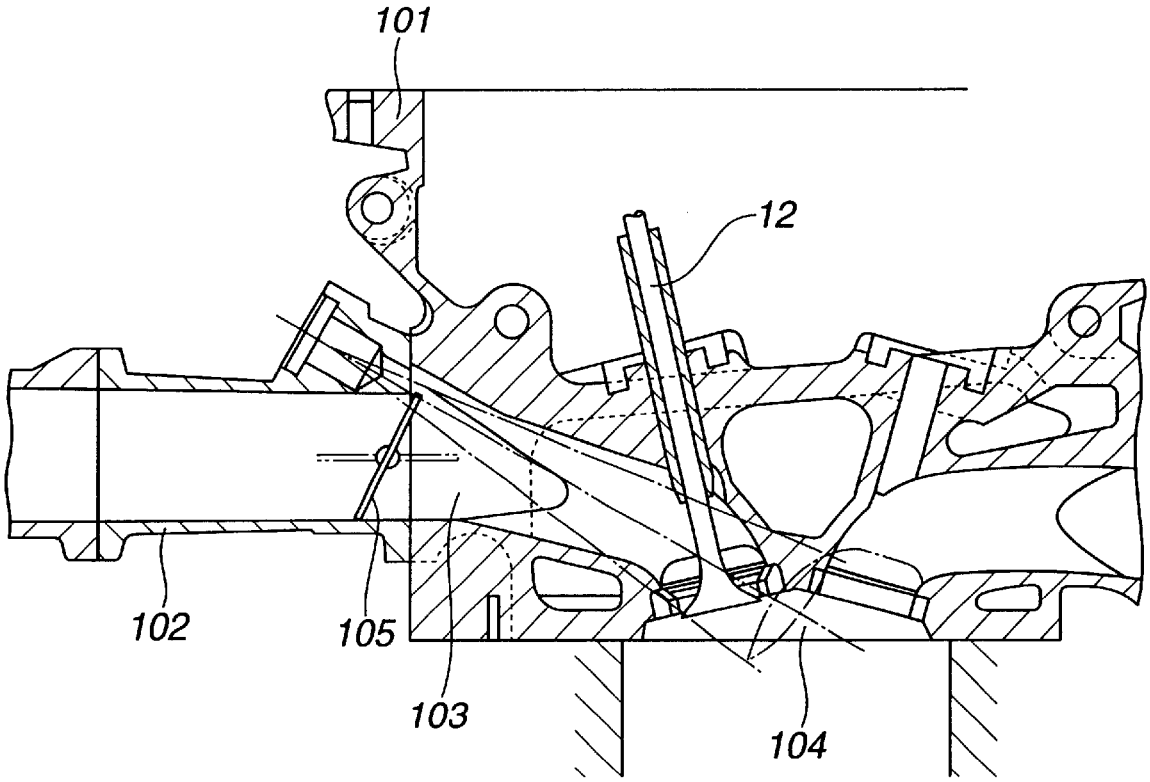
FIG. 12 is a sectional view of a part of an internal combustion engine in which a swirl control valve employed in the second embodiment is provided.
Figure 13:
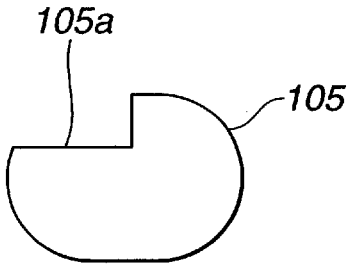
FIG. 13 is a plan view of the swirl control valve.
Figure 14:
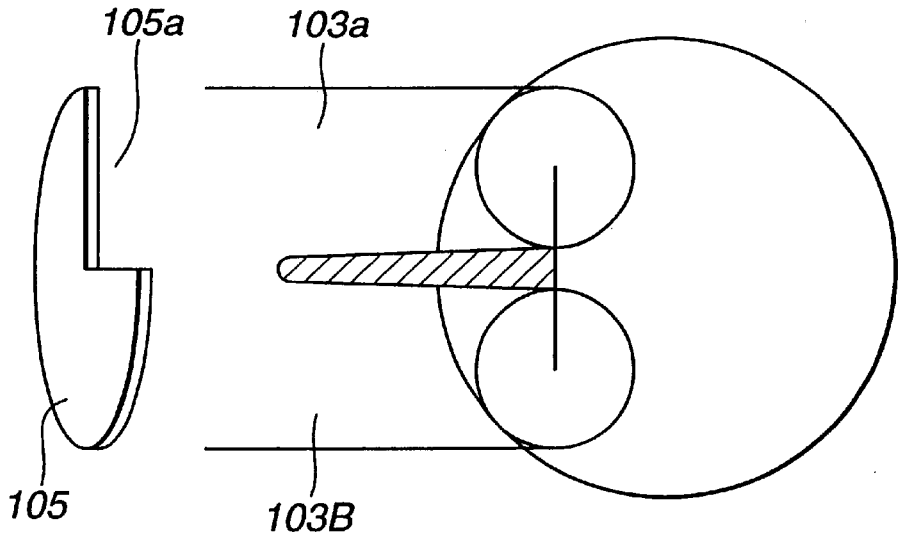
FIG. 14 is a schematic view of an induction system of the engine where the swirl control valve is installed.
Figure 28:
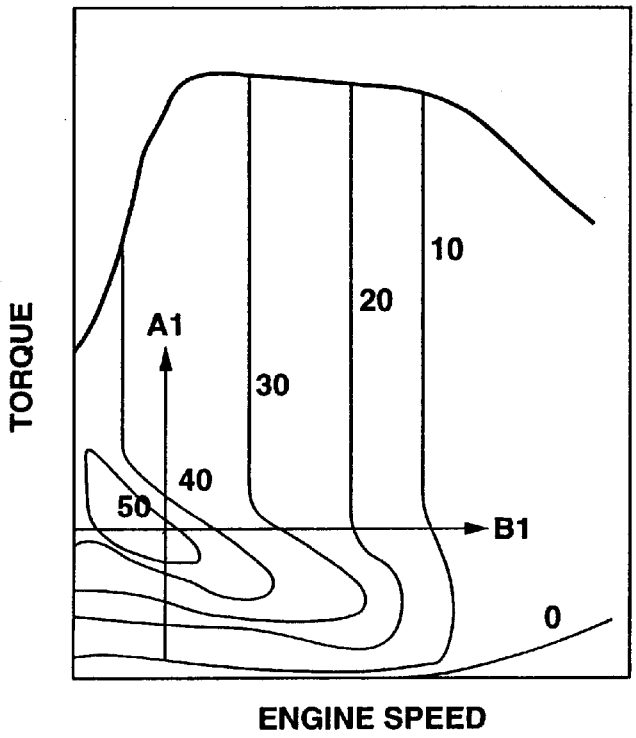
FIG.28 (PRIOR ART)
FIG. 28 is an engine map for controlling the center angle of the operating angular range of the intake valve, which is used in a known valve control device.

FIGS. 12 to 14 show an intake system of an internal combustion engine to which the second embodiment is practically applied. As will be described in detail in the following, in this intake system, there is arranged a swirl control valve 105 that enhances a mixture flow in the intake system.

As is shown in FIG. 12, intake air is led into a combustion chamber 104 through an intake manifold 102 and an intake port 103. As is seen from FIG. 14, the intake port 103 is branched into two intake ports 103*a* and 103*b* each having an electromagnetically actuated intake valve 12 (see FIG. 12). That is, upon lifting of the intake valves 12, intake air is led into the combustion chamber 104.

As is seen from FIG. 12, the swirl control valve 105 is installed in the manifold near the intake port 103. As is seen from FIGS. 13 and 14, the swirl control valve 105 has a cut 105*a* at a portion facing the intake port 103*a*. Accordingly, when the swirl control valve 105 assumes its close position, intake air is permitted to enter the combustion chamber 104 through the cut 105*a*, which produces a swirl of mixture in the combustion chamber 104.

In the following, variation of the operating angular range of the intake valve and that of the center angle, which are induced by increase of engine speed under a low-and-middle load operation range of the engine, will be described with reference to FIGS. 10 and 11, in case of the second embodiment.

In a low-and-middle speed operation range (viz., extremely low speed condition F9 to middle-high speed condition F10), a relatively stable combustion is obtained by closing the swirl control valve 105 even when in the extremely low speed condition F9. That is, even in this condition F9, the IVO can be advanced near the top dead center and thus pumping loss can be reduced and thus fuel consumption is improved.

In the low-and-middle speed operation range, the IVO is advanced with respect to the close timing of the exhaust valve (viz., valve overlapping) with increase of the engine speed, so that the residual gas is caught by newly led intake air thereby reducing the pumping loss. By delaying the IVC, the amount of the newly led intake air, which would be reduced with increase of the valve overlapping, can be compensated.

That is, in the above-mentioned low-and-middle speed operation range, with increase of the engine speed, the operating angular range of the intake angle is increased keeping the center angle at a constant level. In other words, the variation of the operating angular range is controlled larger than that of the center angle.

Figure 15:
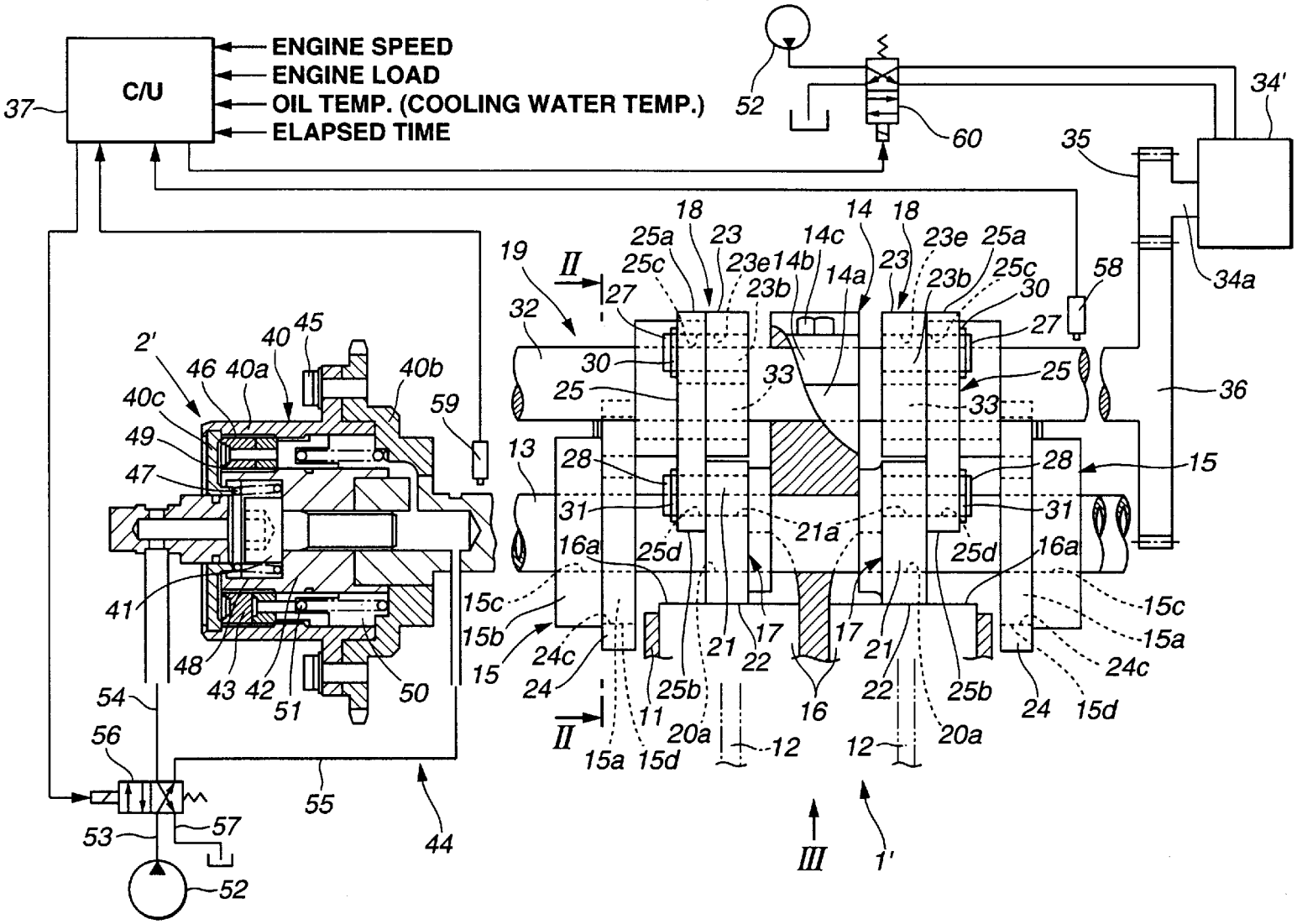
FIG. 15 is a view similar to FIG. 1, but showing a valve control device of a third embodiment of the present invention.

Referring to FIG. 15, there is shown a valve control device. of an internal combustion engine, which is a third embodiment of the present invention. Similar to the above-mentioned first and second embodiments, the valve control device of this third embodiment is constructed to control two intake valves for each cylinder of the engine.

Since the control valve device of the third embodiment is similar in construction to that of the above-mentioned first embodiment of FIG. 1, only parts that are different from those of the first embodiment will be mainly described in detail in the following for simplification of the description. Substantially the same parts as those of the first embodiment are denoted by the same numerals.

The valve control device of the third embodiment comprises generally a first variable valve actuating mechanism 1' that continuously varies the operating angular range (or valve lift degree) of the intake valves 12 and a second variable valve actuating mechanism 2' that continuously varies the center angle of the operating angular range and a control unit 37 that controls the first and second variable valve actuating mechanisms 1' and 2' in accordance with operation condition of the engine.

In the third embodiment, a hydraulically controlled step motor 34' is used. Between the step motor 34' and the oil pump 52, there is installed a solenoid type switching valve 60 that is controlled by the control unit 37. That is, based on instruction signal from the control unit 37, the control shaft 32 is rotated stepwise changing the angular position thereof.

That is, based on the engine speed, load, oil temperature, elapsed time from engine start, etc., the control unit 37 sets a target value "Qt" of the operating angular range of the intake valve 12. Furthermore, based on a rotation angle of the control shaft 32 detected by the first position sensor 58, an existing value "Qn" of the operating angular range is estimated. Based on these two values "Qt" and "Qn", the control unit 37 issues an instruction signal to the switching valve 60 to actuate the step motor 34'. With this, the control cams 33 are rotated to a predetermined angular position through the control shaft 32.

Similar to the above, based on the engine speed, load, oil temperature, elapsed time from the engine start, etc., the control unit 37 sets a target value "Rt" of the center angle of the operating angular range of the intake valve 12. An existing value "Rn" of the center angle is detected by the second position sensor 59. Based on these values "Rt" and "Rn", the control unit 37 issues an instruction signal to the other switching valve 56. With this instruction signal, the first hydraulic passage 54 and the main gallery 53 are connected for a given time and the second hydraulic passage 55 and the drain passage 57 are connected for a given time. Upon this, the tubular gear 43 is moved axially to change a relative angular position between the timing sprocket 40 and the drive shaft 13 in an advanced direction.

In order to accurately control the operating angular range of the intake valve 12 and the center angle of the range, a feedback control is carried out based on the information signals from the first and second position sensors 58 and 59.

Figure 16:
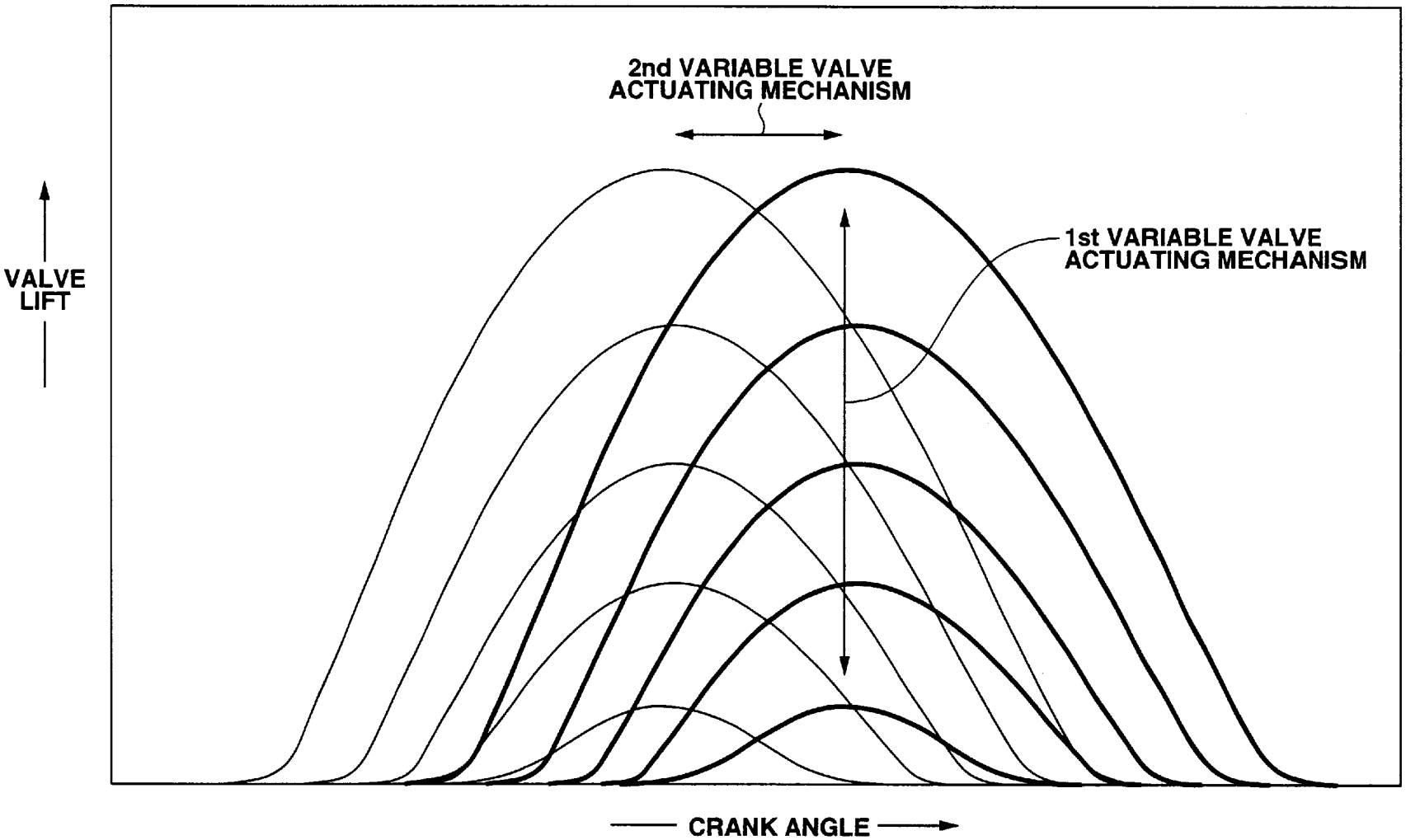
FIG. 16 is a graph showing valve lift characteristic curves obtainable by first and second variable valve actuating mechanisms employed in the third embodiment.

FIG. 16 is a graph showing valve lift characteristic curves obtained by the first and second variable valve actuating mechanisms 1' and 2'.

As is seen from this graph, when the first variable valve actuating mechanism 1' is operated, the operating angular range (or valve lift degree) is continuously varied keeping the center angle at a constant level. While, when the second variable valve actuating mechanism 2' is operated, the center angle of the operating angular range is shifted in advanced or delayed direction keeping the operating angular range (or valve lift degree) at a constant level.

As is seen from FIG. 16, the operating angular range and the valve lift degree have a proportional relationship with each other. Thus, in the following description, either one of these two terms will be freely chosen to facilitate understanding of the description.

FIGS. 17 to 20 show engine maps used in this third embodiment. These maps are stored in the ROM of the control unit 37. In each map, X-axis indicates the open timing "IVO" of the intake valve and Y-axis indicates the close timing "IVC" of the intake valve. The dotted zone shows a range in which the lift characteristics induced by the first and second variable valve actuating mechanisms 1' and 2' are variable. The arrow "A1" indicates the direction in which the operating angular range is varied upon operation of the first variable valve actuating mechanism 1', and the arrow "A2" indicates the direction in which the center angle of the operating angular range is varied upon operation of the second variable valve actuating mechanism 2'.

Thus, these maps of FIGS. 17 to 20 represent the variation of the operating angular range and that of the center angle in accordance with the engine operation condition.

In an idle range, the control is so made that the operating angular range (or valve lift degree) of the intake valve 12 shows the minimum value "Q1" and the center angle shows the most-delayed value "R1". With this control, that is, due to reduction of the operating angular range, the friction of the intake valve 12 is reduced and thus the gas flow characteristic is improved thereby to improve combustion of mixture. Furthermore, due to delay of the IVO, the degree of valve overlapping is reduced and thus the residual gas is reduced. Furthermore, due to reduction of the operating angular range, the period for which the residual gas is exposed to an intake vacuum appearing above the piston is reduced, and thus pumping loss is reduced. Furthermore, due to delay of the IVC, the effective compression ratio at a point near lo the bottom dead center "BDC" is increased and thus combustion stability is improved.

In a partial load range (viz., acceleration representing point), the control is so made that the operating angular range shows a middle value "Q2" a little closer to a smaller operating angular range and the center angle shows the most-advanced value "R2", although these values change slightly by the engine. speed and engine load. Thus, due to reduction of the operating angular range and thus that of the valve lift degree, the friction of the intake valve is reduced, and due to lowering of the valve lift degree, the gas flow characteristic is improved thereby to improve combustion of mixture. Due to advance of the IVO, a suitable valve overlapping is obtained and thus an internal EGR (viz., exhaust gas recirculation) is increased thereby to reduce the pumping loss. Furthermore, due to advance of the IVC, the pumping loss is reduced.

In low-speed full-throttle, middle-speed full-throttle and high-speed full-throttle ranges, the control is so made that the center angle shows the most-delayed value "R1". Furthermore, in such ranges, the operating angular range is controlled to increase with increase of the engine speed, and particularly, in the high-speed full-throttle range, the operating angular range is controlled to show the maximum value "Q3". Thus, the IVO and IVC are appropriately controlled in accordance with the engine speed, and thus desired valve overlapping is obtained. Thus, the charging efficiency is increased and thus the maximum output is obtained while keeping a stable combustion.

Figure 17:
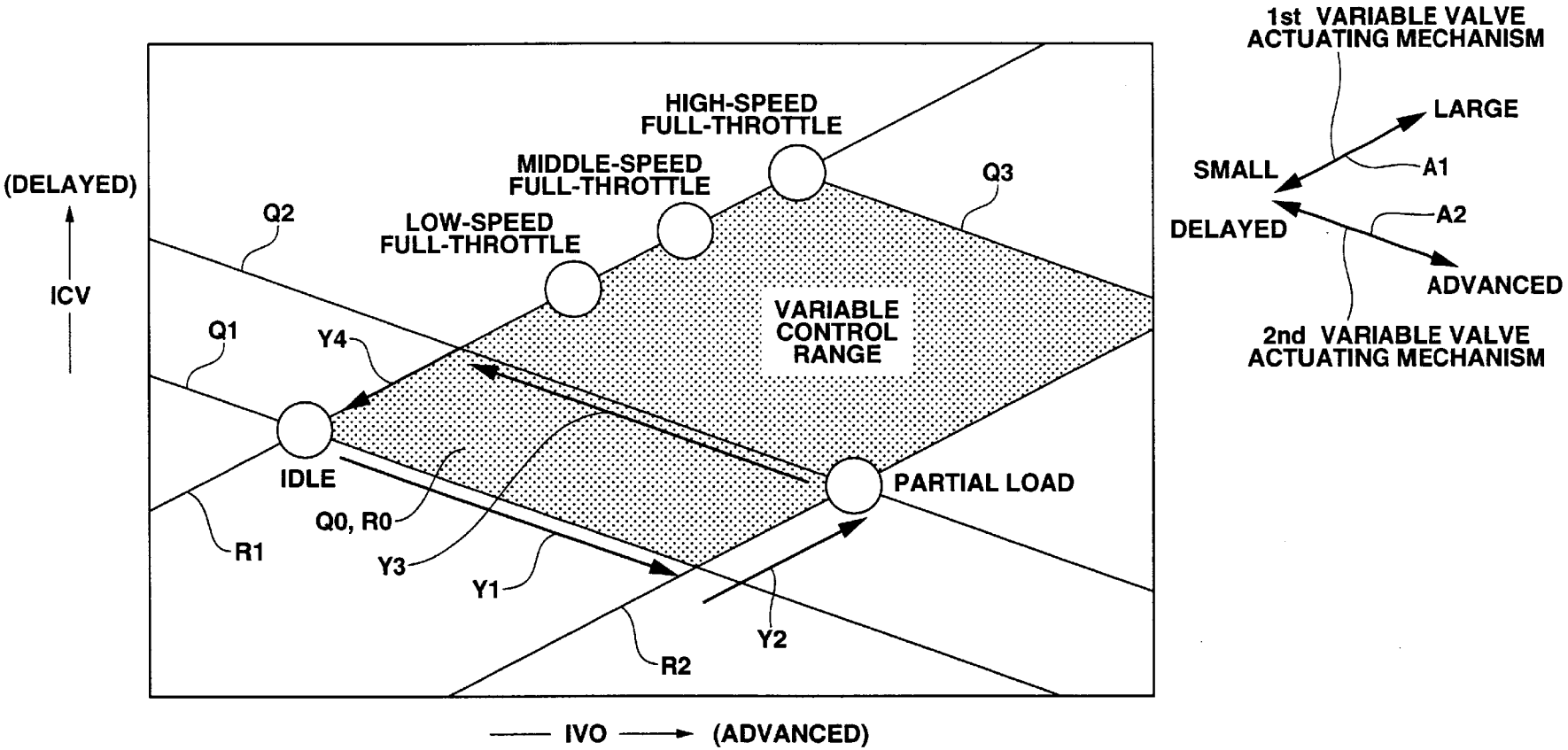
FIGS. 17 to 20 are illustrations of an engine map used in the third embodiment.

Even in a low-speed and low-load operation range wherein hydraulic pressure (or electric power) produced by the engine for operating the two variable valve actuating mechanisms 1' and 2' is not sufficiently supplied, the control of the operating angular range and that of the center angle have to be carried out by the first and second variable valve actuating mechanisms 1' and 2' depending on the circumstances. That is, as is shown in the map of FIG. 17, in a transition range between the idle range and the partial load range, that is, in acceleration or deceleration condition wherein both the engine speed and engine load increase or decrease, the operating angular range has to be controlled as indicated by Q1–Q2 and the center angle has to be largely controlled as indicated by R1 to R2.

In order to suppress or minimize the dispersion of the valve lift characteristic at such transition period, an idea may be thought out wherein so-called temporary target values "Q0" and "R0" are set and switching of the valve lift characteristic is carried out using the temporary target values "Q0" and "R0". However, in this case, after being controlled to have the temporary target values "Q0" and "R0" by the two variable valve actuating mechanisms 1' and 2', it is further necessary to the two variable valve actuating mechanisms 1' and 2' to control the operating angular range and the center angle to have the final target values Q2 and R2 (or Q1 and R1). This is complicated in control and the response speed of switching the valve lift characteristic is lowered.

Thus, in this third embodiment of the invention, in the above-mentioned transition range, only one of the two mechanisms 1' and 2' is operated first to bring one of the operating angular range and center angle into its target value, and then, the other mechanism 1' or 2' is operated to bring the other of the operating angular range and center angle into its target value. With this, undesired dispersion of the valve lift characteristic can be suppressed or at least minimized, and the response speed of switching the valve lift characteristic is increased.

Particularly, in the system wherein the two mechanisms 1' and 2' are powered by the common oil pump 52, it tends to occur that during the switching of the valve lift characteristic provided by the two mechanisms 1' and 2', the hydraulic pressure for the two mechanisms 1' and 2' becomes insufficient causing dispersion of the valve lift characteristics. However, in this third embodiment, since the two mechanisms 1' and 2' are forced to operate one after another, such dispersion is suppressed or at least minimized.

For ease of understanding, such operation will be referred to as "step-by-step operation" of the two mechanisms 1' and 2'.

Figure 21:
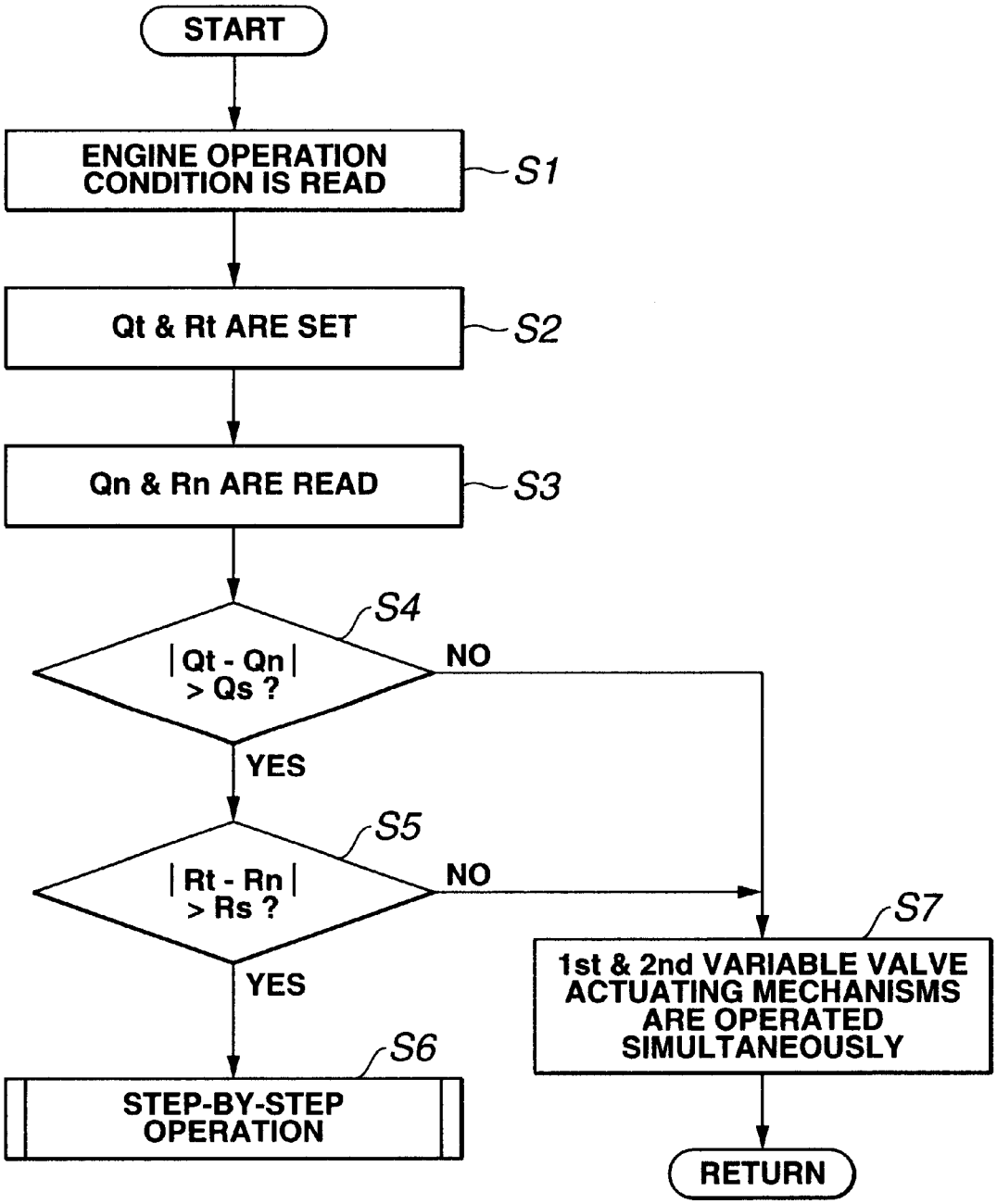
FIG. 21 is a flowchart showing programmed operation steps for controlling the first and second variable valve actuating mechanisms of the third embodiment.

Referring to FIG. 21, there is shown a flowchart showing programmed operation steps executed by the control unit 37 in the third embodiment. More specifically, the flowchart shows a. routine for judging whether the step-by-step operation should be carried out or not.

First, at step S1, operation condition of the engine is read, then at step S2, based on the engine operation condition thus read, a target value "Qt" of the operating angular range which is controlled by the first mechanism 1' and a target value "Rt" of the center angle which is controlled by the second mechanism 2' are set. Then, at step S3, an existing value "Qn" of the operating angular range and an existing value "Rn" of the center angle are read. Then, at step S4, judgement is carried out as to whether the difference "|Qt−Qn|" is larger than a threshold value "Qs" or not. If YES, that is, when the difference "|Qt−Qn|" is larger than the threshold value "Qs", the operation flow goes to step S5. At this step S5, judgement is carried out as to whether the difference "|Rt−Rn|" is larger than a threshold value "Rs" or not. If YES, that is, when the difference "|Rt−Rn|" is larger than the threshold value "Rs", the operation flow goes to step S6 which will be described hereinafter.

If NO at step S4 or at step S5, that is, when the difference "|Qt−Qn |" is smaller than the threshold value "Qs" or the difference "|Rt−Rn|" is smaller than the threshold value "Rs", the operation flow goes to step S7. At this step S7, the two mechanisms 1' and 2' are operated simultaneously.

At step S6, the step-by-step operation of the two variable valve actuating mechanisms 1' and 2' is carried out in such a manner as is depicted by the flowchart of FIG. 22, 23, 24, 25 or 26. The selection of one from these flowcharts FIGS. 22 to 26 depends on the characteristics of the control actually needed.

The first flowchart of FIG. 22 will be described with reference to the engine map of FIG. 17.

The routine of this first flowchart is aimed to simplify the control.

As is shown in the map of FIG. 17, in this step-by-step operation, irrespective of acceleration period from the idle range to the partial load range and deceleration from the partial load range to the idle range, only the second mechanism 2' is operated at first as indicated by arrows Y1 and Y3, and then only the first mechanism 1' is operated as indicated by arrows Y2 and Y4.

Figure 22:
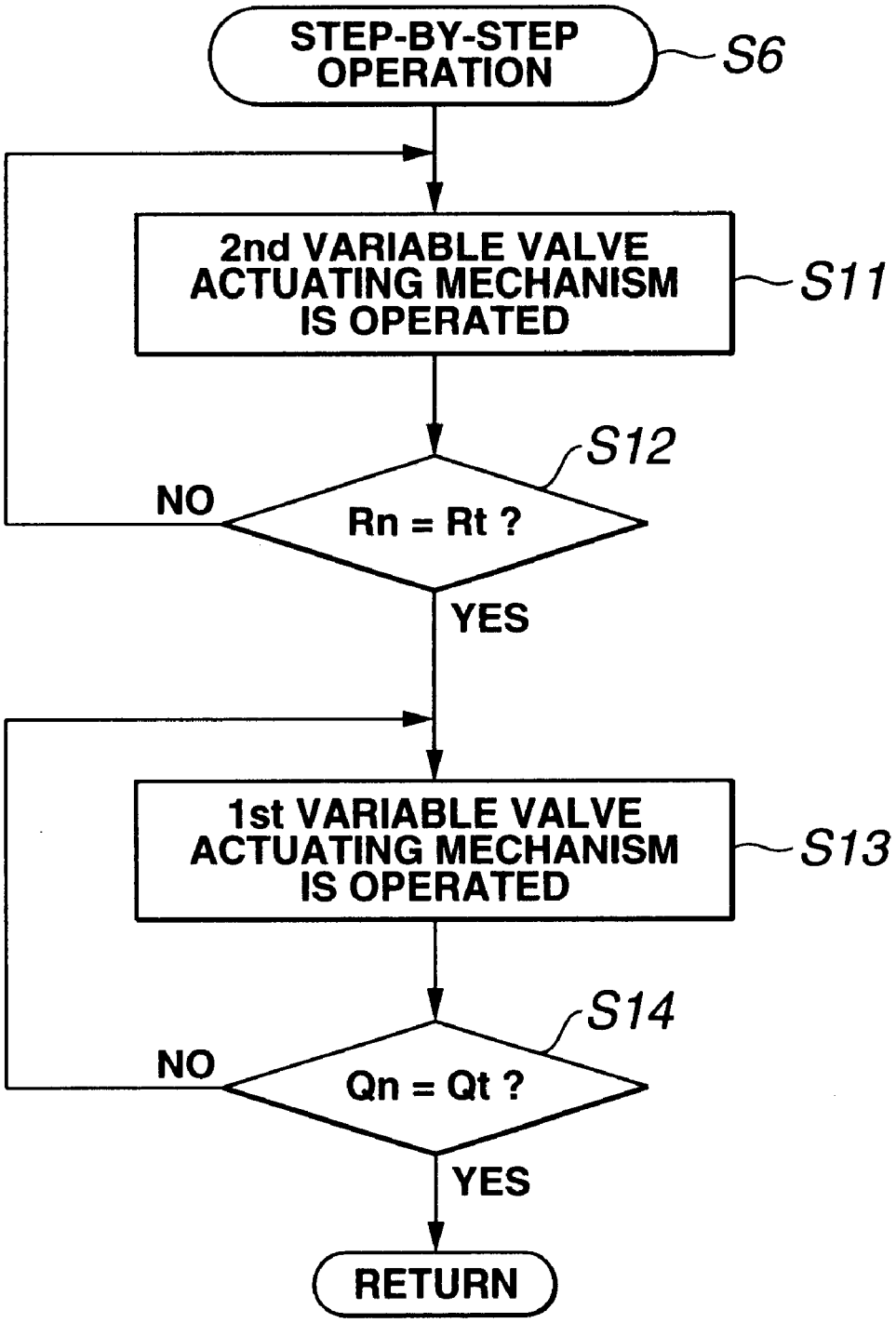
FIG. 22 is a flowchart showing a first example of the detail of step S6 of the flowchart of FIG. 21.

That is, in the flowchart of FIG. 22, at step S11, only the second mechanism 2' is operated, and at step S12, judgement is carried out as to whether "Rn" is equal to "Rt" or not. If NO, the operation flow goes back to step S11. While if YES, that is, when "Rn" is equal to "Rt", the operation flow goes to step S13. That is, based on the information signal from the second position sensor 59, only the second mechanism 2' is operated until the time when the existing value "Rn" of the center angle shows the target value "Rt". At step S13, only the first mechanism 1' is operated, and at step S14, judgment is carried out as to whether "Qn" is equal to "Qt" or not. If NO, the operation flow goes back to step S13, while, if YES, the operation flow goes to return. That is, based on the information signal from the first position sensor 58, only the first mechanism 1' is operated until the time when the existing value "Qn" of the operating angular range shows the target value "Qt".

The second flowchart of FIG. 23 will be described with reference to the engine map of FIG. 18.

The routine of this flowchart is aimed to save the energy actually needed for operating the second mechanism 2'.

Figure 18:
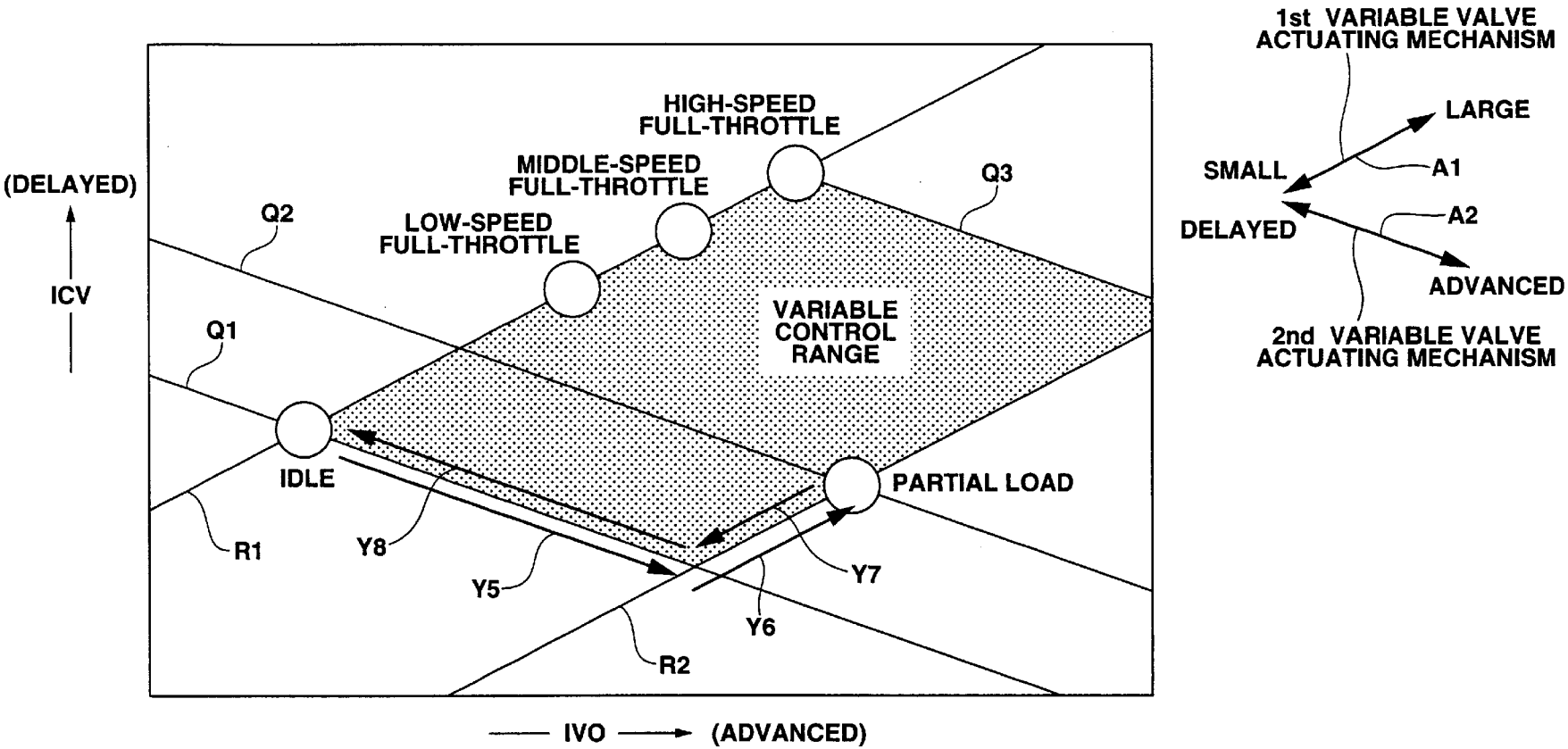

That is, as is shown in the map of FIG. 18, for saving the energy needed for operating the second mechanism 2', the control of the center angle by the second mechanism 2' is carried out while the valve lift degree is relatively small, as indicated by arrows Y5 and Y8. That is, in a case wherein the target value "Q2" of the operating angular range is greater than the existing value "Q1", like in a transition case from the idle range to the partial load range, the center angle is controlled first as indicated by arrow Y5 and then the operating angular range is controlled (viz., increased) as indicated by arrow Y6. While, in a case wherein the target value "Q2" is smaller than the existing value "Q1", like in a transition case from the partial load range to the idle range, the operating angular range is controlled (viz., reduced) first as indicated by arrow Y7 and then the center angle is controlled as indicated by arrow Y8.

Figure 23:
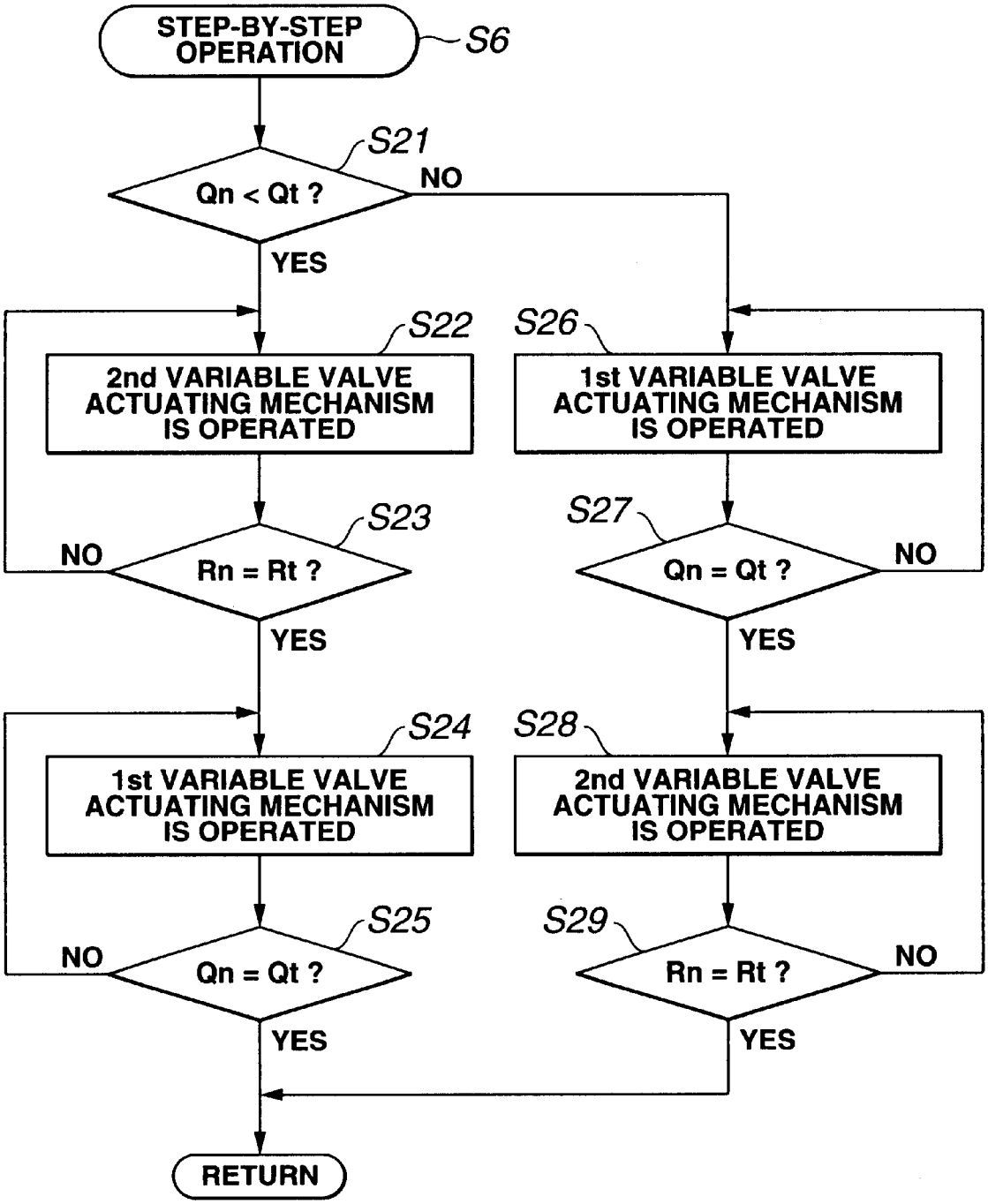
FIG. 23 is a flowchart showing a second example of the detail of step S6 of the flowchart of FIG. 21.

That is, in the flowchart of FIG. 23, at step S21, judgment is carried out as to whether the existing value "Qn" of the operating angular range is smaller than the target value "Qt" or not. If YES, the operation flow goes to step S22. At this step, only the second mechanism 2' is operated, and this operation is kept until the time when the existing value "Rn" of the center angle shows the target value "Rt" (S23). If YES at step S23, that is, when the "Rn" shows "Rt", the operation flow goes to step S24 to operate only the first mechanism 1' until the time when the existing value "Qn" of the operating angular range shows the target value "Qt" (S25). While, if NO at step S21, that is, when the existing value "Qn" of the operating angular range is larger than the target value "Qt", the operation flow goes to step S26 to operate only the first mechanism 1' until the time when the existing value "Qn" shows the target value "Qt" (S27). Upon YES at step S27, the operation flow goes to step S28 to operate only the second mechanism 2' until the time when the existing value "Rn" of the center angle shows the target value "Rt".

The third flowchart of FIG. 24 will be described with reference to the engine map of FIG. 18.

As is seen from the map of FIG. 18, in general, in an acceleration period like in a case wherein the engine operation changes from the idle range to the partial load range, the operating angular range is varied in an increase direction as indicated by arrow Y6, while in a deceleration period like in a case wherein the engine operation changes from the partial load range to the idle range, the operating angular range is varied in a decrease direction as indicated by arrow Y7.

Thus, in the routine of this flowchart, based on the engine speed, judgement is carried out as to whether the engine operation is under acceleration or deceleration. And, if the engine is under acceleration, only the second mechanism 2' is operated first (Y5) and then only the first mechanism 1' is operated, while if the engine is under deceleration, only the first mechanism 1' is operated first (Y7) and then only the second mechanism 2' is operated.

Figure 24:
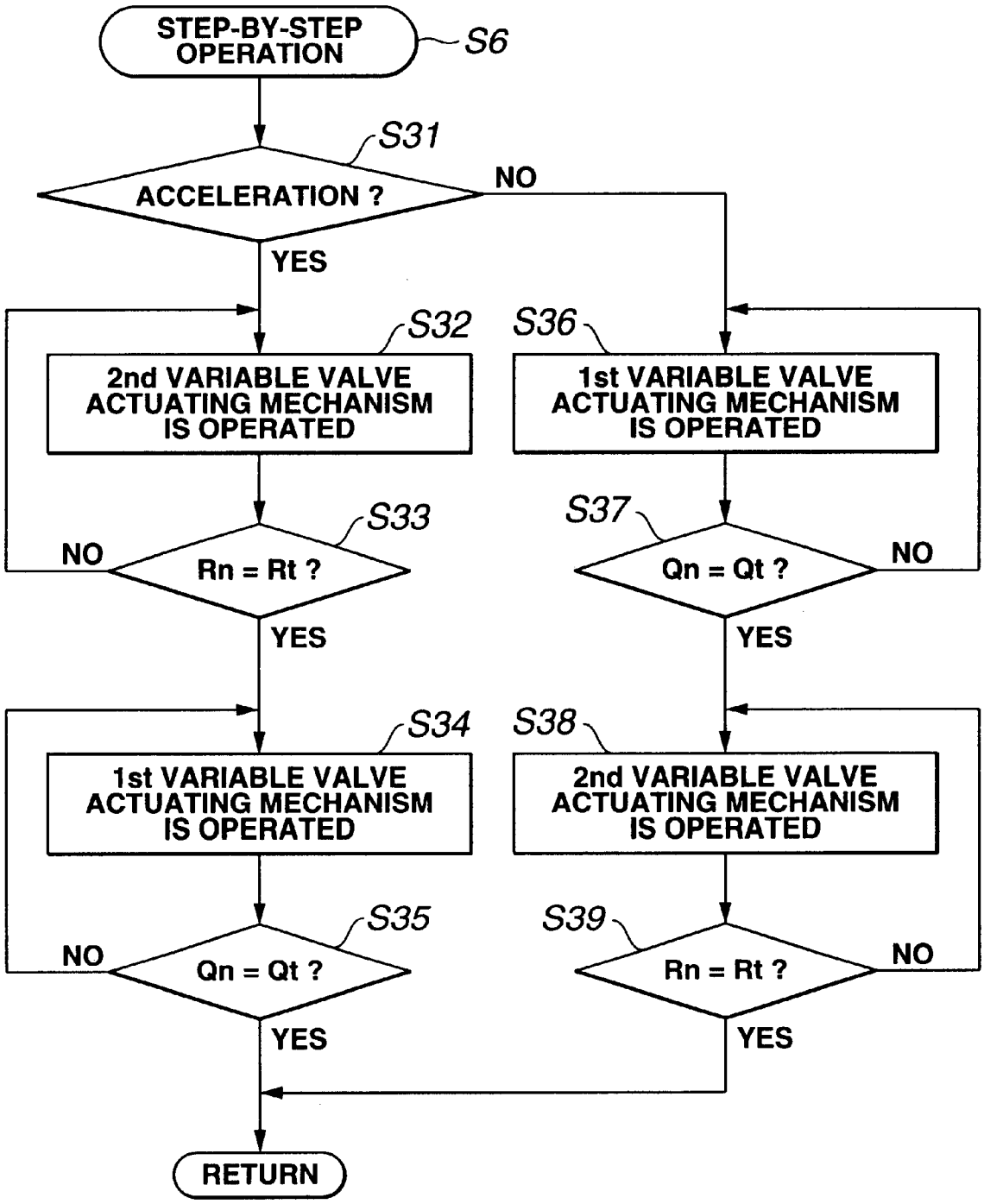
FIG. 24 is a flowchart showing a third example of the detail of step S6 of the flowchart of FIG. 21.

That is, in the third flowchart of FIG. 24, at step S31, judgement is carried out as to whether the engine operation is under acceleration or not. If YES, that is, when the engine operation is under acceleration, the operation flow goes to step S32 to operate only the second mechanism 2' until the time when the "Rn" shows the "Rt" (S33). Then, the operation step goes to step S34 to operate only the first mechanism 1' until the time when "Qn" shows "Qt" (S35). While if NO at step S31, that is, when the engine operation is under deceleration, the operation flow goes to step S36 to operate only the first mechanism 1' until the time when the "Qn" shows "Qt" (S37). Then, the operation flow goes to step S38 to operate only the second mechanism 2' until the time when the "Rn" shows the "Rt".

In the routine of the third flowchart of FIG. 24, the output of the second mechanism 2' is effectively controlled in both the acceleration and deceleration conditions, and thus, similar to the case of the above-mentioned second flowchart of FIG. 23, undesired dispersion of the valve lift characteristic at the time of switching is suppressed or at least minimized and the response speed of the switching is improved.

The fourth flowchart of FIG. 25 will be described with reference to the engine map of FIG. 19.

Figure 19:
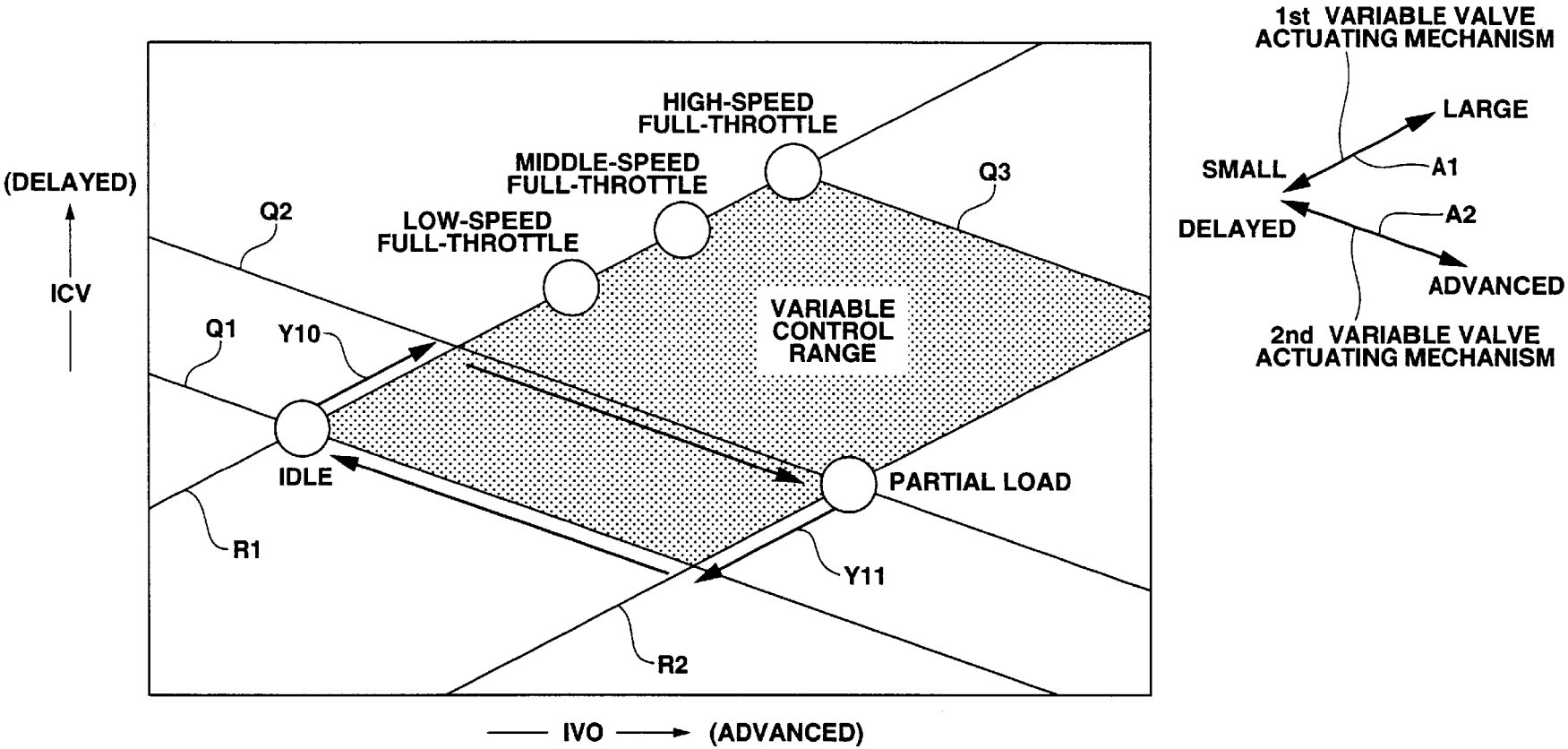

As is seen from the map of FIG. 19, when acceleration of the engine starts from the time when the valve lift degree (viz., operating angular range) is small, only the first mechanism 1' is operated first for increasing the valve lift degree first, as indicated by arrow Y10. With this, air intake resistance is instantly reduced and thus acceleration of the engine is improved. Furthermore, since increasing of the valve lift degree is effected. under acceleration of the engine speed, dynamically advantageous effect is obtained and thus undesired surge sounds can be suppressed or at least minimized.

In a system using the above-mentioned first mechanism 1' by which the valve lift degree (viz., operating angular range) of the valve is continuously controlled, fuel consumption and exhaust characteristics can be further improved by setting the operating angular range "Q1" in the idle range to a value smaller than a value set in a low-speed and full-throttle range. However, if the engine undergoes acceleration with the operating angular range "Q1" kept very small, the charging efficiency becomes lowered due to marked air intake resistance, which tends to bring about a poor fuel consumption. Furthermore, due to the very small valve lifting, the valve spring fails to produce a sufficient counterforce which tends to bring about unbalanced operation of the engine and undesired surge sounds.

Accordingly, in the routine of the fourth flowchart, the valve lift degree (or operating angular range) is increased at first when acceleration of the engine starts from the time when the valve lift degree is small, that is, when the operating angular range "Q1" is small. With this, the above-mentioned undesired phenomena are overcome.

While, when deceleration of the engine starts from the time when the valve overlapping is relatively large (or the center angle is advanced), like in a transition period from the partial load range to the idle range, only the first mechanism 1 is operated first for prioritizing reduction of the valve lift degree (viz., operating angular range) as indicated by arrow Y11 in the map of FIG. 19. With this, the gas flow is enhanced while keeping the combustion improving effect by the valve overlapping, and thus, driveability, fuel consumption and exhaust characteristic are improved.

Figure 25:
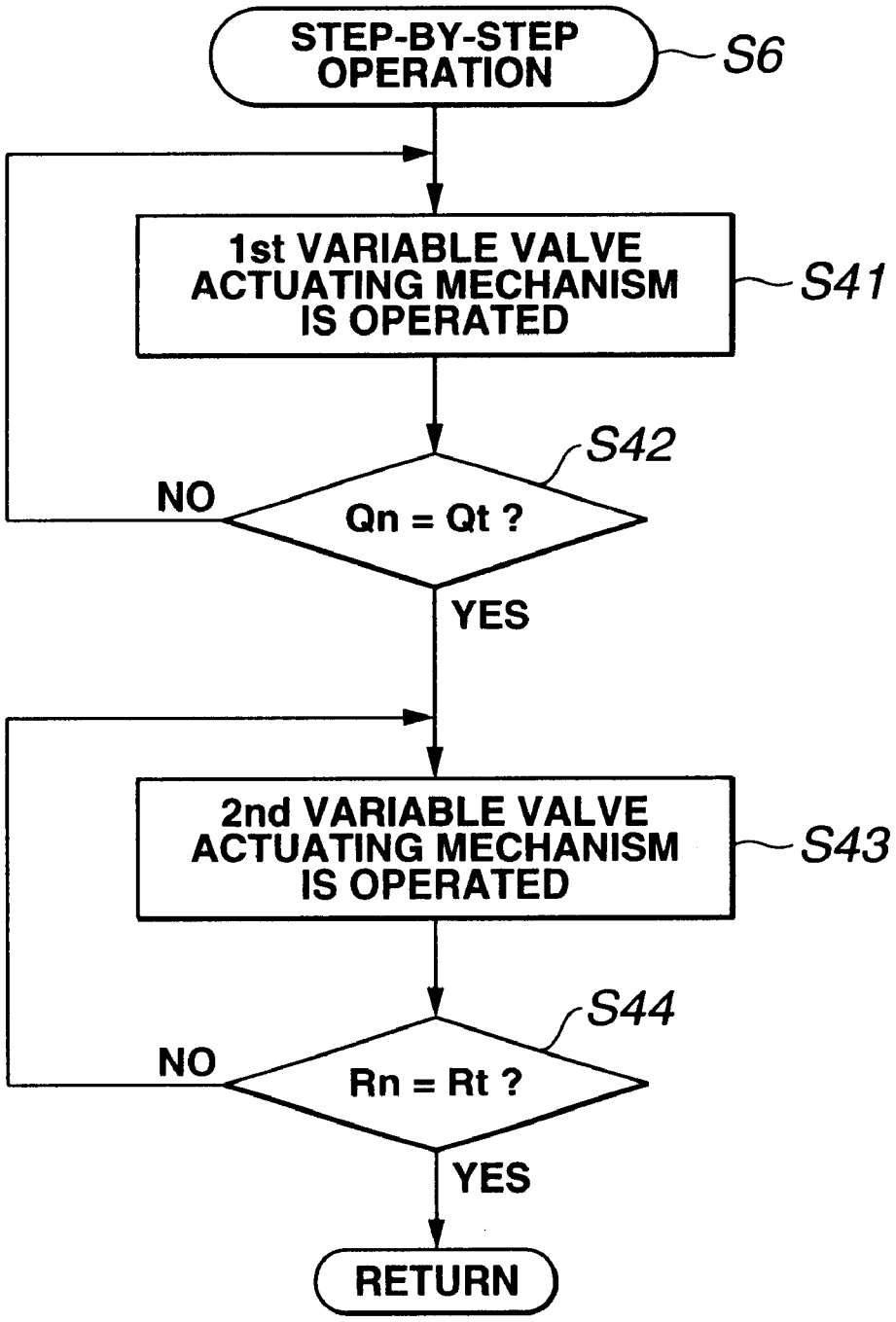
FIG. 25 is a flowchart showing a fourth example of the detail of step S6 of the flowchart of FIG. 21.

That is, in the routine of the fourth flowchart of FIG. 25, at step S41, when the engine is under either acceleration or deceleration, only the first mechanism 1' is operated until the time when "Qn" shows "Qt" (S42). Then, at step S43, only the second mechanism 2' is operated until the time when "Rn" shows "Rt".

The fifth flowchart of FIG. 26 will be described with reference to the engine map of FIG. 20.

Figure 20:
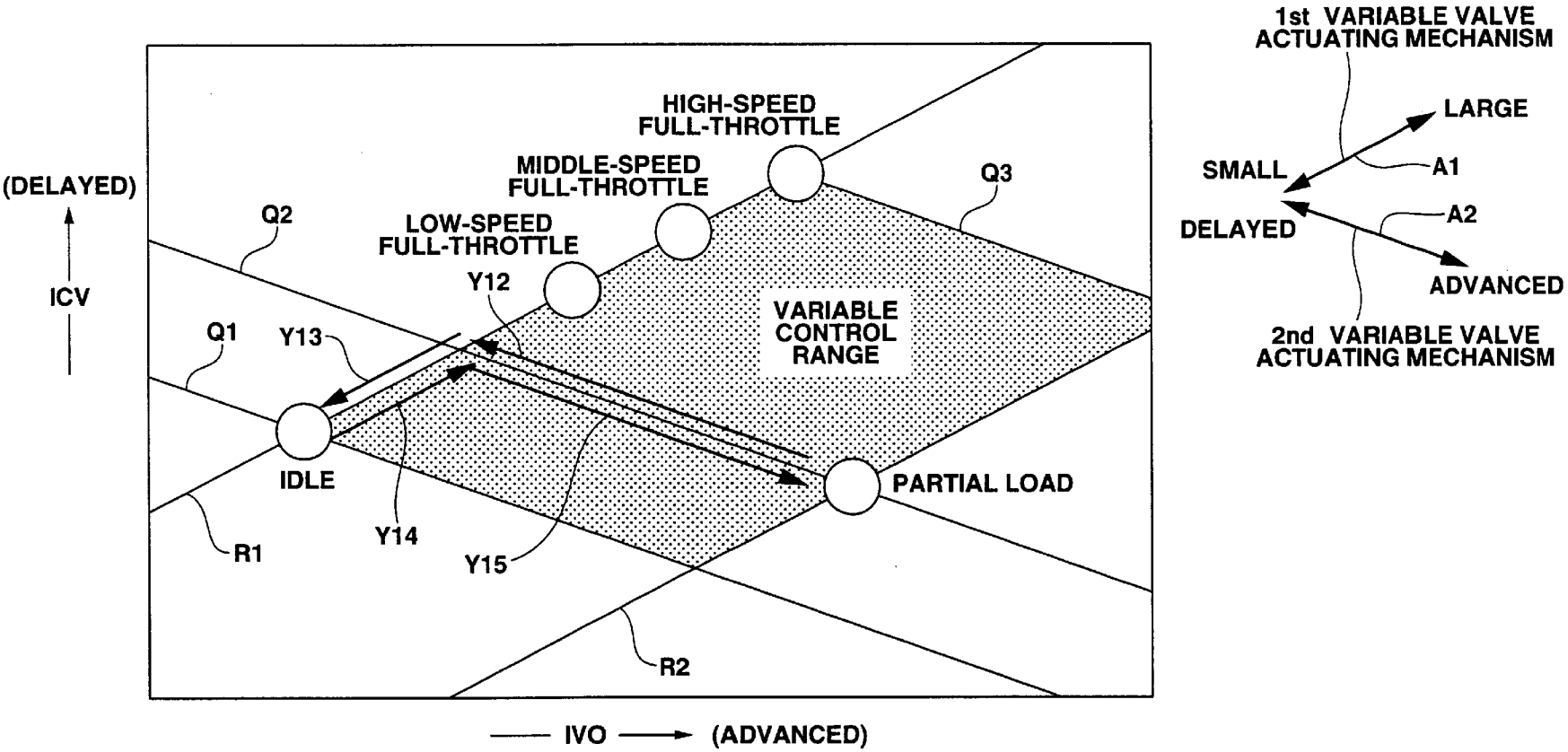

As is seen from the map of FIG. 20, under deceleration, sharp drop of engine rotation does not take place due to the work of a so-called engine rotation inertia. However, unbalanced operation of the engine and undesired surge sounds tend to take place. Thus, in the routine of the fifth flowchart, under deceleration, the center angle is controlled to the target value at first while the valve lift degree (or operating angular range) is large as indicated by arrow Y12, and then the operating angular range is controlled as indicated by arrow Y13. It is to be noted that when the valve lift degree is large, the counterforce of the valve spring is relatively large. With such control, the undesired unbalanced operation of the engine and the undesired surge sounds are suppressed or at least minimized.

While, under acceleration, the operating angular range is controlled at first as indicated by arrow Y14 and then the center angle is controlled as indicated by arrow Y15, similar to the case of the above-mentioned fourth flowchart.

Figure 26:
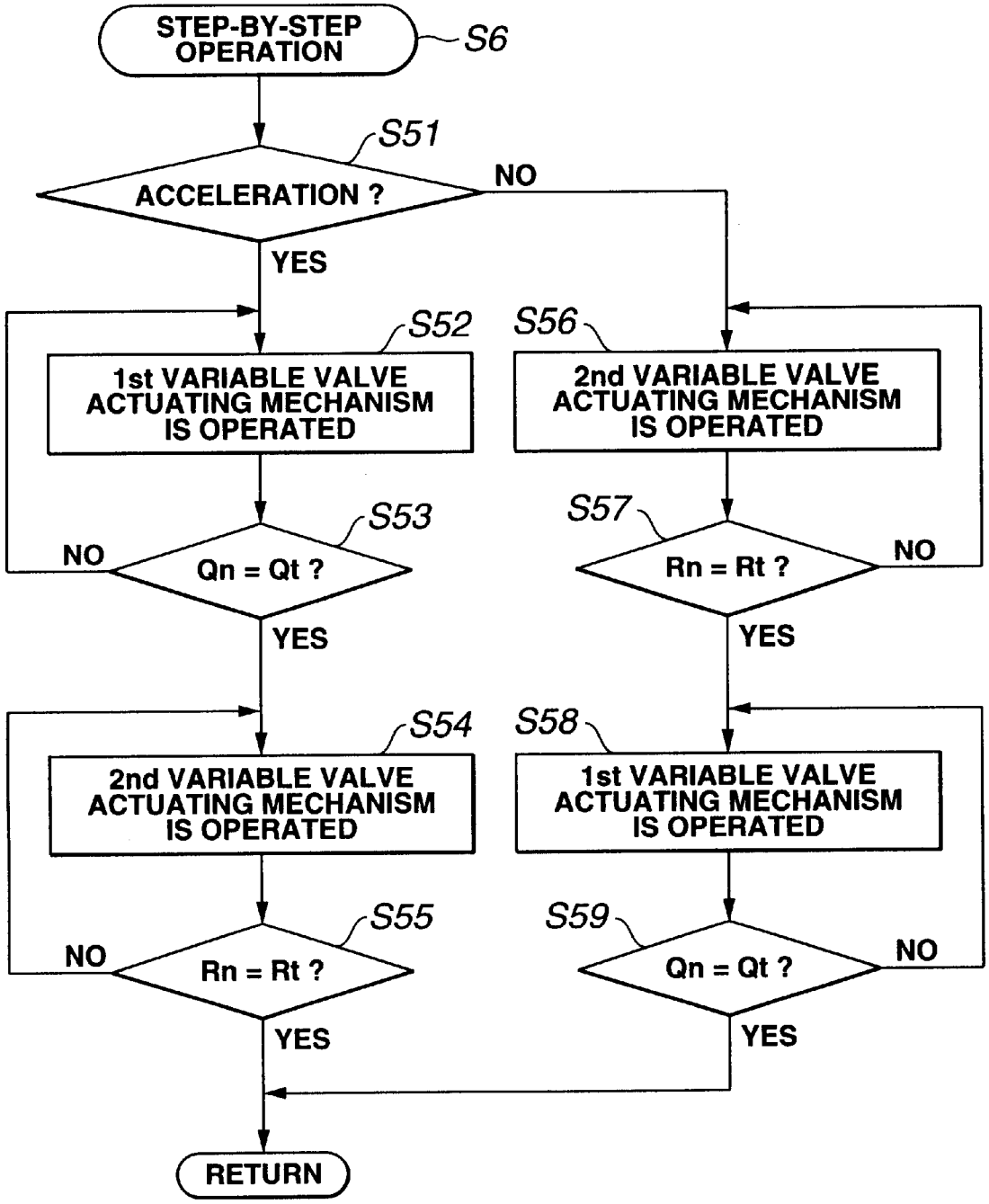
FIG. 26 is a flowchart showing a fifth example of the detail of step S6 of the flowchart of FIG. 21.

That is, in the fifth flowchart of FIG. 26, at step S51, judgement is carried out as to whether the engine is under acceleration or not. If YES, that is, when the engine is under acceleration, the operation flow goes to step S52 to operate only the first mechanism 1' until the time when the "Qn" shows "Qt" (S53). Then, the operation flow goes to step S54 to operate only the second mechanism 2' until the time when "Rn" shows "Rt" (S55). While, if NO at step S51, that is, when the engine is deceleration, the operation flow goes to step S56 to operate only the second mechanism 2' until the time when "Rn" shows "Rt" (S57). Then, the operation flow goes to step S58 to operate only the first mechanism 1' until the time when "Qn" shows "Qt".

Figure 27:
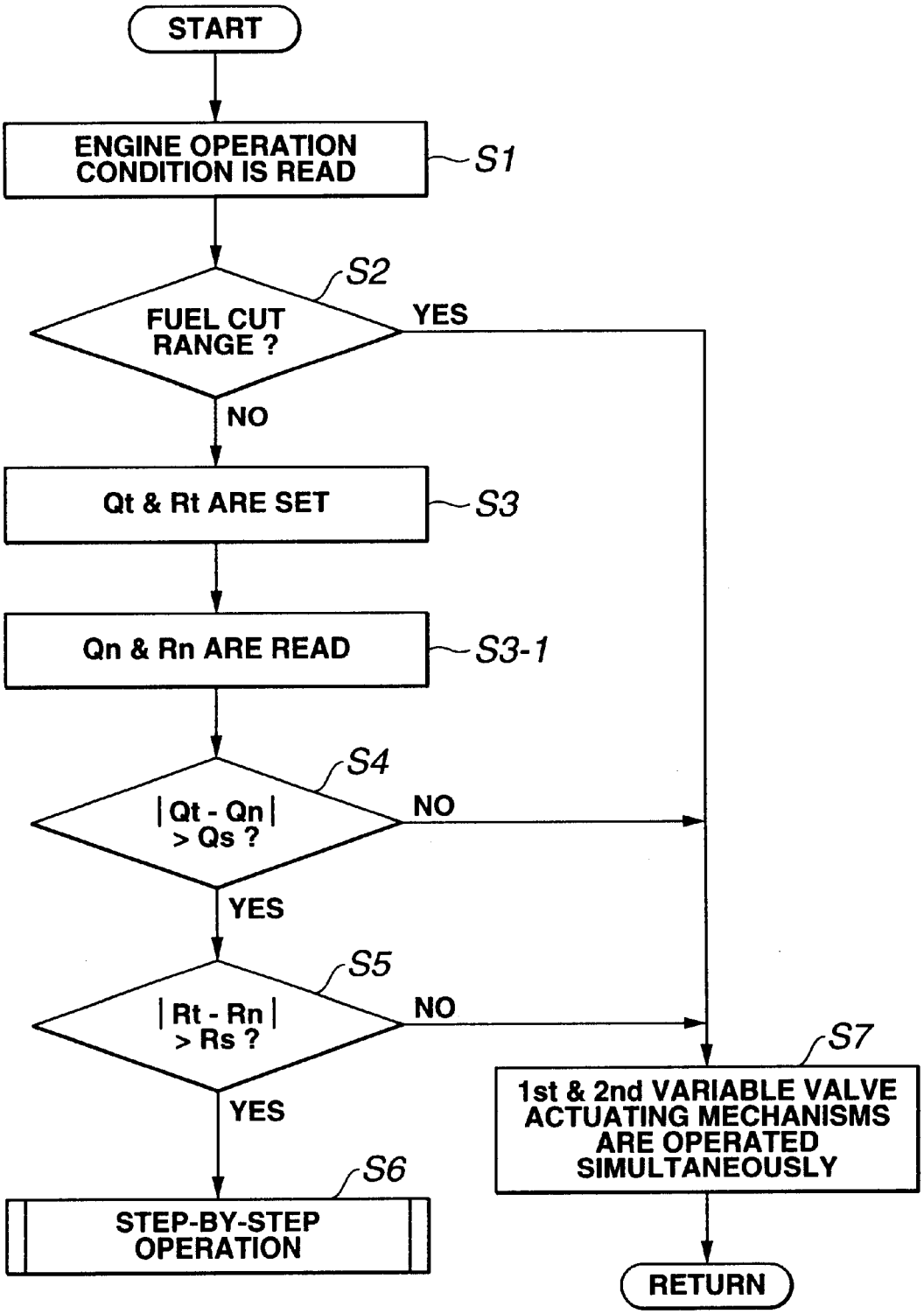
FIG. 27 is a flowchart showing programmed operation steps for controlling the first and second variable valve actuating mechanisms of a fourth embodiment of the present invention.

Referring to FIG. 27, there is shown a flowchart showing programmed operation steps executed by the control unit 37 in a fourth embodiment of the invention. More specifically, the flowchart of FIG. 27 is usable in place of the flowchart of FIG. 21.

That is, in a fuel-cut range wherein fuel cut takes place due to ON condition of an idle switch, mixture combustion does not take place. Thus, in this fourth embodiment, in such fuel-cut range, the driveability of the engine is not largely affected even if the valve lift characteristic is somewhat dispersed. Based on this fact, the fourth embodiment is provided.

That is, at step S1, operation condition of the engine is read and at step S2, based on the engine operation condition thus read, judgement is carried out as to whether the engine operation is in fuel-cut range or not. If YES, that is, when the engine operation is in fuel-cut range, the operation flow goes to step S7 to operate the first and second mechanisms 1' and 2' simultaneously. That is, so-called step-by-step operation of the mechanisms 1' and 2' is not carried out in such fuel-cut range. If NO at step S2, that is, when the engine operation is in a so-called fuel supply range, the operation flow goes to steps S3, S3-1, S4, S5 and S6 like in the case of the flowchart of FIG. 21.

When the hydraulic pressure for the two mechanisms 1' and 2' is turned OFF while the engine assumes the idle range, the above-mentioned fuel-cut operation is easily carried out by turning OFF the hydraulic pressure upon ON operation of the idle switch. In this case, the control is simplified.

A fifth embodiment will be described in the following.

In the above-mentioned valve control device, based on the angular position of the control shaft 32 detected by the first position sensor 58, the existing value "Qn" of the operating angular range (or valve lift degree) is estimated, and at the same time, based on a phase difference between the rotation angle of the drive shaft 13 and the rotation angle of the crankshaft, which are both detected by the second position sensor 59, the existing value "Rn" of the center angle is estimated. Thus, in such valve control device, the existing value "Rn" of the center angle is obtained once per each rotation of the cam, and thus, it takes a not less time until the existing value "Rn" shows the target value "Rt".

Thus, in this fifth embodiment, by the time substantially needed until the existing value "Rn" shows the target value "Rt", the operation of the second mechanism 2' is advanced inducing advanced control of the center angle, and upon expiration of the time, the operation of the first mechanism 1' is started inducing control of the operating angular range. With this, the time needed for obtaining the target valve lift characteristic can be shortened. In this fifth embodiment, after one of the operating angular range and center angle reaches the corresponding target value, the control of the other is started. However, if desired, at the time when reduction of hydraulic pressure for suppressing overshoot starts, the control of the other may start.

In the present invention, the following modifications are also usable.

In the above-mentioned embodiments, the first and second mechanisms 1, 1', 2 and 2' are constructed to control only the intake valves 12. However, if desired, these mechanisms 1, 1', 2 and 2' may be constructed to control the exhaust valves. Furthermore, if desired, one of the mechanisms may be applied to the intake valves 12 and the other may be applied to the exhaust valves.

The entire contents of Japanese Patent Applications 2000-81105 (filed Mar. 23, 2000) and 2000-97225 (filed Mar. 31, 2000) are incorporated herein by reference.

Although the invention has been described above with reference to the embodiments of the invention, the invention is not limited to such embodiments as described above. Various modifications and variations of such embodiments may be carried out by those skilled in the art, in light of the above description.

What is claimed is:

1. A valve control device of an internal combustion engine having intake and exhaust valves, comprising:

a first variable valve actuating mechanism which varies an operating angular range of the intake valve;

a second variable valve actuating mechanism which varies a center angle of said operating angular range; and a control unit which controls, through said first and second variable valve actuating mechanisms, said operating angular range and said center angle in accordance with an operation condition of the engine, said control unit being configured to carry out:

in a low-output operation range of the engine, advancing said center angle with increase of the engine output while making the variation of the center angle larger than that of the operating angular range; and in a middle-output operation range of the engine, increasing the operating angular range with increase of the engine output while making the variation of the operating angular range larger than that of the center angle.

2. A valve control device as claimed in claim 1, in which said control unit is further configured to carry out:

in a high-output operation range of the engine, delaying the center angle with increase of the engine output while making the variation of the center angle larger than that of the operating angular range.

3. A valve control device as claimed in claim 1, in which said control unit is configured to carry out:

in a low-load operation range of the engine, advancing said center angle with increase of the engine load while making the variation of the center angle larger than that of the operating angular range; and in a middle-load operation range of the engine, increasing the operating angular range with increase of the engine load while making the variation of the operating angular range larger that of the center angle.

4. A valve control device as claimed in claim 2, in which said control unit is configured to carry out:

in a high-load operation range of the engine, delaying the center angle with increase of the engine load while making the variation of the center angle larger than that of the operating angular range.

5. A valve control device as claimed in claim 1, in which said control unit is configured to carry out:

in a low-speed operation range of the engine, advancing said center angle with increase of the engine speed while making the variation of the center angle larger than that of the operating angular range; and in a middle-speed operation range of the engine, increasing the operating angular range with increase of the engine speed while making the variation of the operating angular range larger than that of the center angle.

6. A valve control device as claimed in claim 2, in which said control unit is configured to carry out:

in a high-speed operation range of the engine, increasing the operating angular range and delaying the center angle with increase of the engine speed, so as to delay the close timing of the intake valve while keeping the open timing of the intake valve generally constant.

7. A valve control device as claimed in claim 1, further comprising a device that enhances a mixture flow in the intake system of the engine, and in which said control unit is configured to carry out:

in a middle-load and extremely low-speed operation range of the engine, bringing the open timing of the intake valve to a point near the top dead center; and in a middle-load and low-and-middle speed operation range of the engine, increasing the operating angular range with increase of the engine speed while making the variation of the operating angular range larger than that of the center angle.

8. A valve control device as claimed in claim 1, in which said first variable valve actuating mechanism comprises:

a drive shaft rotated together with a crankshaft of the engine;

a swing cam rotatably disposed on said drive shaft and actuating said intake valve;

a drive cam eccentrically and tightly disposed on said drive shaft to rotate together therewith;

a ring-shaped link rotatably disposed about said drive cam;

a control shaft extending in parallel with said drive shaft;

a control cam eccentrically and tightly disposed on said control shaft to rotate together therewith;

a rocker arm rotatably disposed about said control cam and having one end connected to said ring-shaped link; and a rod-shaped link connecting the other end of said rocker arm with said swing cam.

9. A valve control device as claimed in claim 1, further comprising a first unit that obtains an existing value of the operating angular range and a second unit that obtains an existing value of the center angle, and in which said control unit is configured to carry out:

setting a target value of said operating angular range and that of said center angle respectively in accordance with the operation condition of the engine; and operating only one of the first and second variable valve actuating mechanisms at least in a case wherein a first difference between the target value of the operating angular range and the existing value of the same exceeds a first threshold value and a second difference between the target value of the center angle and the existing value of the same exceeds a second threshold value.

10. A valve control device as claimed in claim 9, in which said control unit is configured to carry out:

operating only one of the first and second variable valve actuating mechanisms first until the time when one of the operating angular range and said center angle reaches the corresponding target value; and then operating the other of the first and second variable valve actuating mechanisms.

11. A valve control device as claimed in claim 10, in which said control unit is configured to carry out:

operating the second variable valve actuating mechanism first when the existing value of the operating angular range is smaller than the target value of the same; and operating the first variable valve actuating mechanism first when the existing value of the operating angular range is larger than the target value of the same.

12. A valve control device as claimed in claim 10, in which said control unit is configured to carry out:

operating said second variable valve actuating mechanism first when the engine is under acceleration; and operating said first variable valve actuating mechanism first when the engine is under deceleration.

13. A valve control device as claimed in claim 10, in which said control unit is configured to carry out:

operating said first variable valve actuating mechanism first when the acceleration of the engine starts from the time when the lift degree of the intake valve is small.

14. A valve control device as claimed in claim 10, in which said control unit is configured to carry out:

making the operating angular range in an idle operation range smaller than that in a low-speed and full-throttle operation range; and operating said first variable valve actuating mechanism first when acceleration of the engine starts from the idle operation range.

15. A valve control device as claimed in claim 14, in which said control unit is configured to carry out:

operating said first variable valve actuating mechanism when the engine is under deceleration.

16. A valve control device as claimed in claim 14, in which said control unit is configured to carry out:

operating said second variable valve actuating mechanism when the engine is under deceleration.

17. A valve control device as claimed in claim 10, in which said control unit is configured to carry out:

operating one of the first and second variable valve actuating mechanisms first and then operating only the other of the mechanisms when the engine is in an operation range except a fuel-cut range.

18. A valve control device as claimed in claim 10, in which said first variable valve actuating mechanism varies the operating angular range when said control shaft is rotated, said first unit estimates the existing value of the operating angular range based on a rotation angle of said control shaft, said second variable valve actuating mechanism varies the center angle when the drive shaft is rotated relative to the crankshaft of the engine, said second unit estimates the existing value of the center angle based on a phase difference between the rotation angle of the drive shaft and that of the crankshaft, and said control unit is configured to carry out operating only said second variable valve actuating mechanism first and then operating only said first variable valve actuating mechanism.

19. A valve control device as claimed in claim 18, in which said first and second valve actuating mechanisms are both powered by a common drive unit.

20. A valve control device of an internal combustion engine having intake and exhaust valves, comprising:

first means for varying an operating angular range of said. intake valve;

second means for varying a center angle of said operating angular range; and control means for controlling, through said first and second means, said operating angular range and said center angle in accordance with an operation condition of the engine, said control means being configured to carry out:

in a low-output operation range of the engine, advancing said center angle with increase of the engine output while making the variation of the center angle larger than that of the operating angular range; and in a middle-output operation range of the engine, increasing the operating angular range with increase of the engine output while making the variation of the operating angular range larger than that of the center angle.

21. In a valve control device of an internal combustion engine having intake and exhaust valves, said valve control device including a first variable valve actuating mechanism which varies an operating angular range of said intake valve and a second variable valve actuating mechanism which varies a center angle of said operating angular range, a method for controlling said valve control device in accordance with an operation condition of the engine, comprising:

operating said first and second variable valve actuating mechanisms in such a manner as to, in a low-output operation range of the engine, advance said center angle with increase of the engine output while making the variation of the center angle larger than that of the operating angular range; and operating said first and second variable valve actuating mechanisms in such a manner as to, in a middle-output operation range of the engine, increase the operating angular range with increase of the engine output while making the variation of the operating angular range larger than that of the center angle.

* * * * *